US010974876B2

(12) United States Patent
Backs et al.

(10) Patent No.: US 10,974,876 B2
(45) Date of Patent: Apr. 13, 2021

(54) FLUID CONTAINER HAVING FLUID LEVEL INDICATORS

(71) Applicant: CamelBak Products, LLC, Petaluma, CA (US)

(72) Inventors: Jochen Backs, Mill Valley, CA (US); Kaydee Boone, Rohnert Park, CA (US); Jeff Davies, Windsor, CA (US)

(73) Assignee: CamelBak Products, LLC, Petaluma, CA (US)

( * ) Notice: Subject to any disclaimer, the term of this patent is extended or adjusted under 35 U.S.C. 154(b) by 0 days.

(21) Appl. No.: 16/707,915

(22) Filed: Dec. 9, 2019

(65) Prior Publication Data

US 2020/0115119 A1 Apr. 16, 2020

Related U.S. Application Data

(63) Continuation of application No. 16/012,043, filed on Jun. 19, 2018, now Pat. No. 10,532,862.

(51) Int. Cl.
*B65D 47/06* (2006.01)
*B65D 25/48* (2006.01)

(52) U.S. Cl.
CPC ..... *B65D 47/06* (2013.01); *B65D 25/48* (2013.01); *B65D 2517/0049* (2013.01); *B65D 2543/00046* (2013.01)

(58) Field of Classification Search
CPC ..... B65D 47/00; B65D 47/06; B65D 47/068; B65D 25/48; B65D 25/54; B65D 25/56
See application file for complete search history.

(56) References Cited

U.S. PATENT DOCUMENTS

| | | | | |
|---|---|---|---|---|
| 4,196,857 | A * | 4/1980 | Bauer | B05B 1/08 239/327 |
| 5,494,198 | A * | 2/1996 | Heiberger | A47J 41/022 220/592.25 |
| 10,532,862 | B2 * | 1/2020 | Backs | B65D 25/48 |
| 2008/0006718 | A1 * | 1/2008 | Junkel | A45F 3/16 239/333 |
| 2008/0190941 | A1 * | 8/2008 | Olson | A47F 3/001 220/592.26 |
| 2011/0165399 | A1 * | 7/2011 | Cording | C03C 17/322 428/220 |
| 2014/0069606 | A1 * | 3/2014 | Lee | A61J 9/001 165/63 |
| 2017/0143154 | A1 * | 5/2017 | Li | A47J 27/21166 |
| 2018/0050844 | A1 * | 2/2018 | Hirst | A47G 21/18 |
| 2018/0155101 | A1 * | 6/2018 | Spann | B65D 21/0212 |

* cited by examiner

*Primary Examiner* — Steven A. Reynolds
*Assistant Examiner* — Javier A Pagan
(74) *Attorney, Agent, or Firm* — Amardeep S. Grewal; Gerard M. Donovan; Reed Smith LLP

(57) ABSTRACT

A fluid container including a fluid vessel having a neck with an opening and having an internal compartment sized to hold a volume of fluid, the internal compartment being at least partially enclosed by an opaque layer, a closure assembly removably coupled to the fluid container to cover the opening, and two or more fluid level indicators defined in the opaque layer, each fluid level indicator comprising a translucent or transparent material configured to permit light to pass through the opaque layer and into the internal compartment, at least two of the two or more fluid level indicators being positioned on circumferentially opposed sides of the fluid vessel.

22 Claims, 9 Drawing Sheets

FLUID CONTAINER HAVING FLUID LEVEL INDICATORS

RELATED APPLICATION INFORMATION

This application is a continuation of U.S. Nonprovisional application Ser. No. 16/012,043, filed Jun. 19, 2018, the disclosure of which is hereby incorporated by reference in its entirety.

FIELD

The present disclosure relates to fluid containers, and more particularly to fluid containers having fluid level indicators.

BACKGROUND

Many individuals carry drink containers that hold water or other potable beverages, such as for personal hydration during athletic activities. These drink containers typically include a bottle that is formed from plastic or metal. These containers also frequently include a closure, such as a cap or lid, which is removably secured to a neck or other opening of the bottle. As an example, some such drink containers include a threaded closure that is tethered to the neck of the container. Some conventional drink containers further include a drink spout, or nozzle, that is integral with the closure and from which liquid may be drawn from the drink bottle without removal of the cap from the bottle. Some such nozzles include a manual or automatic valve for selectively restricting liquid from being dispensed through the nozzle, and some do not. Examples of such drink containers with valved nozzles include squeezable drink containers with push-pull drink spouts and CAMELBAK® brand drink containers with bite-actuated mouthpieces.

In some cases, such as during athletic activities, an individual may wish to cool and/or wash themselves or other objects with water that is stored in the drink container, such as by showering themselves or the other objects with water dispensed from the drink spout. However, dispensing water though the drink spout may produce a volume of fluid flow that is too large and/or concentrated to produce an efficient and/or pleasant shower effect. Thus, there exists a need for drink containers with distinct dispensing modes.

SUMMARY

Closure assemblies with distinct dispensing modes and drink containers including the same are disclosed herein. A closure assembly includes a closure base, which is configured to be selectively coupled to a neck of a liquid vessel to selectively couple the closure assembly to the liquid vessel, and a valve assembly operatively coupled to the closure base. The valve assembly includes at least one drink outlet, at least one shower outlet, and a barrel valve, such that each drink outlet is spaced apart from each shower outlet.

The valve assembly is configured to be selectively transitioned between a closed configuration, a drink configuration, and a shower configuration. In the drink configuration, the valve assembly permits flow of the potable drink liquid from an internal compartment of the liquid vessel through an opening of the neck of the liquid vessel and to the at least one drink outlet. In the drink configuration, the valve assembly also restricts flow of the potable drink liquid through the at least one shower outlet. In the shower configuration, the valve assembly permits flow of the potable drink liquid from the internal compartment through the opening and to the at least one shower outlet. In the shower configuration, the valve assembly also restricts flow of the potable drink liquid through the at least one drink outlet. In the closed configuration, the valve assembly restricts flow of the potable drink liquid from the internal compartment through the opening and to each of the at least one drink outlet and the at least one shower outlet. The barrel valve is configured to be selectively rotated relative to the closure base, such as about a rotational axis of the closure assembly to transition the valve assembly between the closed configuration, the drink configuration, and the shower configuration.

A fluid container having fluid level indicators is disclosed herein. The fluid container includes a fluid vessel having a neck with an opening and having an internal compartment sized to hold a volume of fluid, the internal compartment being at least partially enclosed by an opaque layer, a closure assembly removably coupled to the fluid container to cover the opening, and two or more fluid level indicators defined in the opaque layer, each fluid level indicator comprising a translucent or transparent material configured to permit light to pass through the opaque layer and into the internal compartment, at least two of the two or more fluid level indicators being positioned on circumferentially opposed sides of the fluid vessel.

DETAILED DESCRIPTION

FIGS. 1-17 provide examples of drink containers 10, of liquid vessels 20, and/or of closure assemblies 100, according to the present disclosure. Elements that serve a similar, or at least substantially similar, purpose are labeled with like numbers in each of FIGS. 1-17, and these elements may not be discussed in detail herein with reference to each of FIGS. 1-17. Similarly, all elements may not be labeled in each of FIGS. 1-17, but reference numbers associated therewith may be utilized herein for consistency. Elements, components, and/or features that are discussed herein with reference to one or more of FIGS. 1-17 may be included in and/or utilized with the subject matter of any of FIGS. 1-17 without departing from the scope of the present disclosure.

In general, elements that are likely to be included in a given (i.e., a particular) embodiment are illustrated in solid lines, while elements that are optional to a given embodiment are illustrated in dash-dot lines. However, elements that are shown in solid lines are not essential to all embodiments, and an element shown in solid lines may be omitted from a given embodiment without departing from the scope of the present disclosure.

Figure 1:
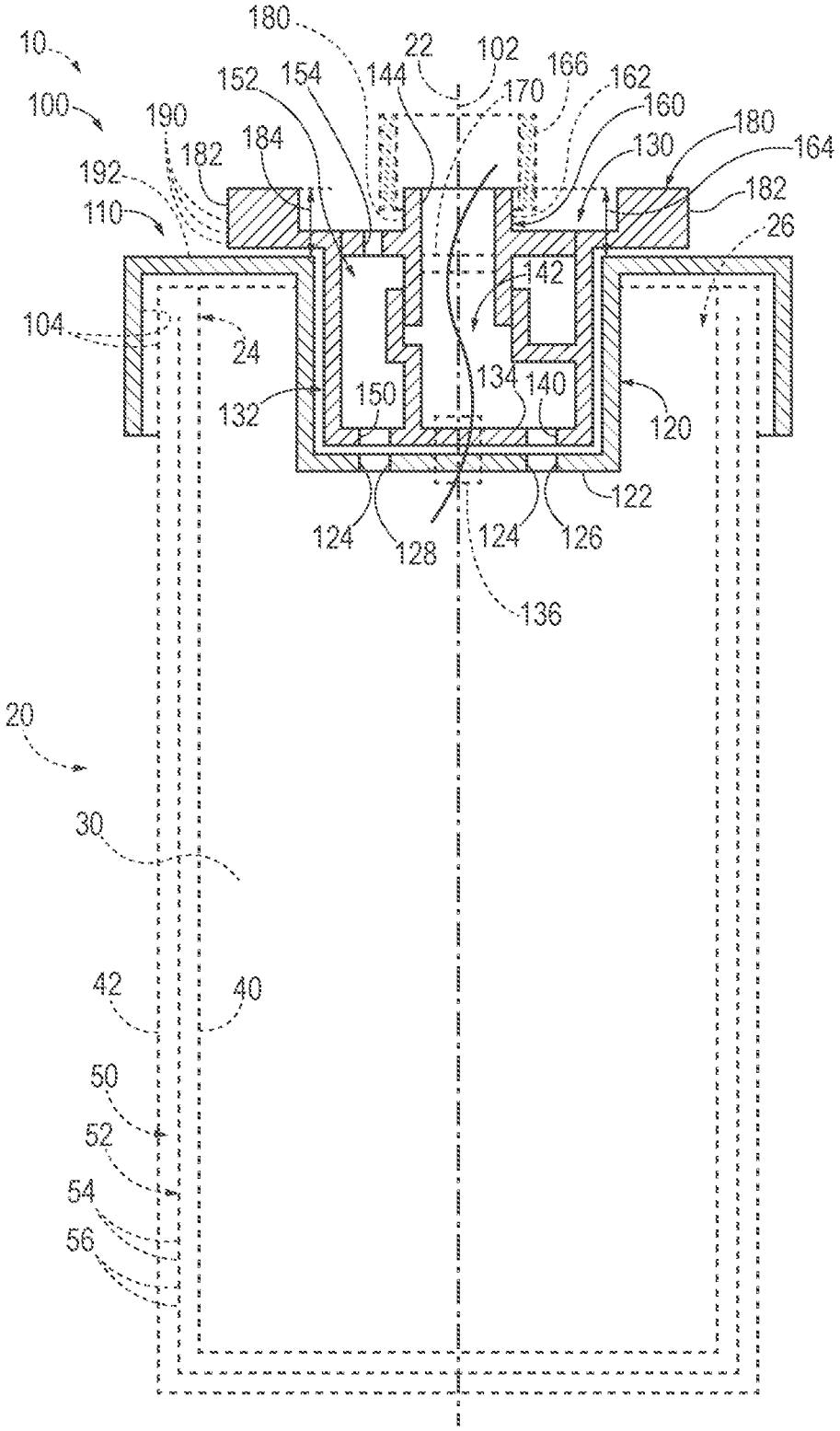
FIG. 1 is a schematic side elevation view representing examples of drink containers including closure assemblies according to the present disclosure.
Figure 2:
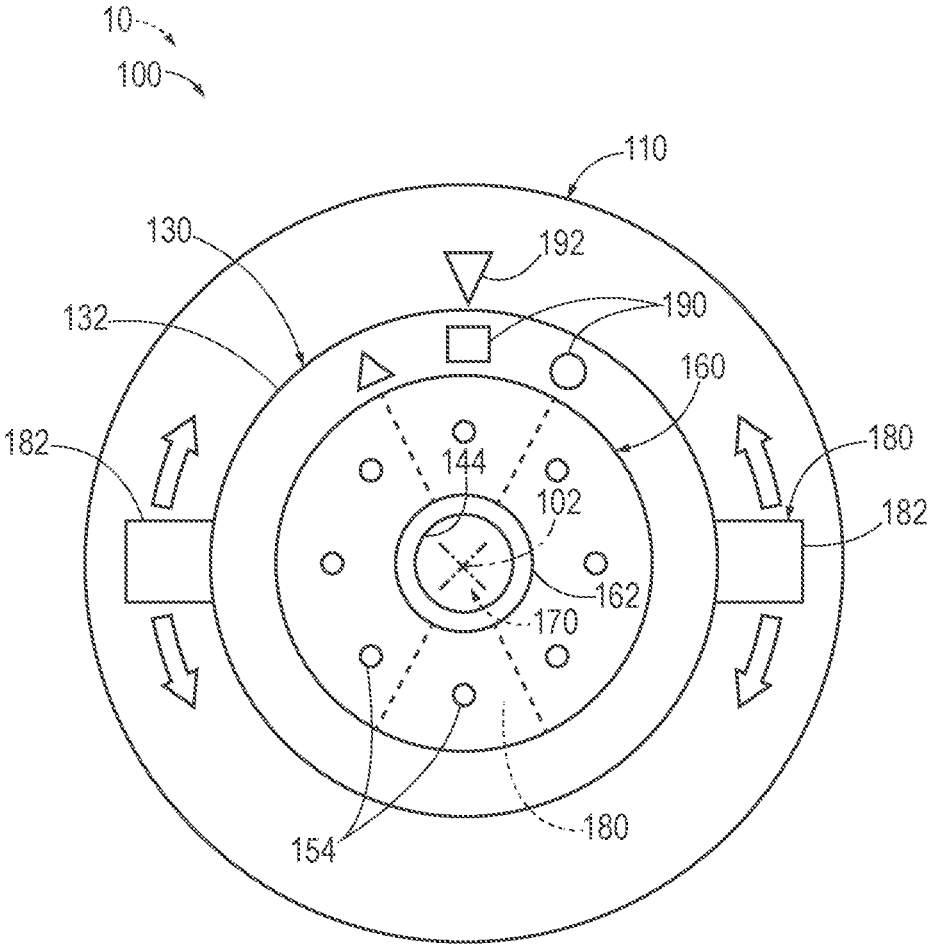
FIG. 2 is a schematic top plan view representing examples of closure assemblies according to the present disclosure.

FIG. 1 is a schematic cross-sectional side elevation view of examples of a drink container 10 that includes a liquid vessel 20 and a closure assembly 100. FIG. 2 is a schematic top plan view of examples of closure assembly 100. As schematically illustrated in FIG. 1, liquid vessel 20 includes a neck 24 with an opening 26. Liquid vessel 20 further includes an internal compartment 30 configured to hold a volume of a potable drink liquid. Examples of potable drink liquids that may be used in drink containers 10 according to the present disclosure include such potable liquids as water, juice, sports drinks, and the like.

Closure assembly 100 is configured to be selectively coupled to neck 24 of liquid container 20. More specifically, closure assembly 100 includes a closure base 110 configured to be selectively coupled to neck 24 of liquid vessel 20 to selectively couple the closure assembly to the liquid vessel. When closure assembly 100 is coupled to the neck 24 of liquid vessel 20, the closure assembly may be described as covering, obstructing, and/or selectively preventing drink liquid from being dispensed from the liquid vessel through opening 26. Closure assembly 100 additionally or alternatively may be referred to as a closure 100, a lid 100, a lid assembly 100, a cap 100, and/or a cap assembly 100.

As schematically illustrated in FIGS. 1-2, closure assembly 100 includes closure base 110 and a valve assembly 130 operatively coupled to closure base 110. Valve assembly 130 includes at least one drink outlet 144 and at least one shower outlet 154, such that each drink outlet 144 is spaced apart from each shower outlet 154. Valve assembly 130 is configured to be selectively transitioned between a closed configuration, a drink configuration, and a shower configuration. In the drink configuration, valve assembly 130 permits flow of the potable drink liquid from internal compartment 30 through opening 26 of liquid vessel 20 and to drink outlet(s) 144. In the drink configuration, valve assembly 130 also restricts flow of the potable drink liquid through shower outlet(s) 154. In the shower configuration, valve assembly 130 permits flow of the potable drink liquid from internal compartment 30 through opening 26 of liquid vessel 20 and to shower outlet(s) 154. In the shower configuration, valve assembly 130 also restricts flow of the potable drink liquid through drink outlet(s) 144. In the closed configuration, valve assembly 130 restricts flow of the potable drink liquid from internal compartment 30 to each drink outlet 144 and each shower outlet 154. As schematically illustrated in FIGS. 1-2, and as discussed in more detail herein, valve assembly 130 additionally includes a barrel valve 132 configured to selectively transition valve assembly 130 between the closed configuration, the drink configuration, and the shower configuration. More specifically, and as discussed in more detail herein, valve assembly 130 may be configured such that fluid may flow through barrel valve 132 when valve assembly 130 is in the drink configuration or in the shower configuration, and such that closure base 110 and/or barrel valve 132 restricts fluid from flowing through barrel valve 132 when valve assembly 130 is in the closed configuration.

Closure assembly 100 may be configured such that a user may transition valve assembly 130 to the drink configuration when the user wants to drink from drink container 10 and/or may transition valve assembly 130 to the shower configuration to dispense the potable drink liquid as a mist or shower comprised of a plurality of individual streams of emitted drink liquid. Stated differently, the potable drink liquid may be dispensed from drink container 10 with distinct flow rates and/or characteristics when valve assembly 130 is in the drink configuration and when valve assembly 130 is in the shower configuration. For example, valve assembly 130 may be configured to permit flow of the potable drink liquid through each drink outlet 144 at a drink flow rate when valve assembly 130 is in the drink configuration, and may be configured to permit flow of the potable drink liquid through each shower outlet 154 at a shower flow rate when valve assembly 130 is in the shower configuration, such that the drink flow rate is greater than the shower flow rate. As more specific examples, the drink flow rate may be at least 1.5 times the shower flow rate, at least 2 times the shower flow rate, at least 5 times the shower flow rate, at least 10 times the shower flow rate, at least 20 times the shower flow rate, at most 50 times the shower flow rate, at most 30 times the shower flow rate, at most 15 times the shower flow rate, at most 7 times the shower flow rate, and/or at most 3 times the shower flow rate.

As another example, valve assembly 130 may be configured to permit flow of the potable drink liquid through each drink outlet 144 at a drink stream velocity when valve assembly 130 is in the drink configuration, and may be configured to permit flow of the potable drink liquid through each shower outlet 154 at a shower stream velocity when valve assembly 130 is in the shower configuration, such that the shower stream velocity is greater than the drink stream velocity. As more specific examples, the shower stream velocity may be at least 1.5 times the drink stream velocity, at least 2 times the drink stream velocity, at least 5 times the drink stream velocity, at least 10 times the drink stream velocity, at least 20 times the drink stream velocity, at most 50 times the drink stream velocity, at most 30 times the drink stream velocity, at most 15 times the drink stream velocity, at most 7 times the drink stream velocity, and/or at most 3 times the drink stream velocity. In the preceding examples of relative flow rates and velocities, the corresponding values are responsive to equal force being applied to the drink container to urge drink liquid to be dispensed from the closure assembly.

Each drink outlet 144 and/or each shower outlet 154 may have any appropriate configurations for achieving the respective flow characteristics. For example, each drink outlet 144 may have a drink outlet cross-sectional area, and each shower outlet 154 may have a shower outlet cross-sectional area, such that the drink outlet cross-sectional area is greater than the shower outlet cross-sectional area. As more specific examples, each drink outlet cross-sectional area may be at least 2 times each shower outlet cross-sectional area, at least 5 times each shower outlet cross-sectional area, at least 10 times each shower outlet cross-sectional area, at least 20 times each shower outlet cross-sectional area, at most 30 times each shower outlet cross-sectional area, at most 15 times each shower outlet cross-sectional area, at most 7 times each shower outlet cross-sectional area, and/or at most 3 times each shower outlet cross-sectional area.

Valve assembly 130 may have any appropriate number of drink outlets 144 and/or of shower outlets 154. As examples, the at least one drink outlet 144 may include 1 drink outlet, at least 2 drink outlets, at least 3 drink outlets, and/or fewer than 5 drink outlets. When valve assembly 130 includes more than one drink outlet 144, the drink outlets may be oriented to emit parallel or converging streams of drink liquid. As additional examples, the at least one shower outlet 154 may include 1 shower outlet, at least 2 shower outlets, at least 5 shower outlets, at least 10 shower outlets, at least 20 shower outlets, fewer than 30 shower outlets, fewer than 15 shower outlets, fewer than 7 shower outlets, and/or fewer than 3 shower outlets. The valve assembly typically will include a plurality of shower outlets 154, with such plurality of shower outlets emitting parallel and/or divergent streams of drink liquid.

Valve assembly 130 may have a greater number of shower outlets 154 than drink outlets 144. In such an example, drink outlet(s) 144 and shower outlets 154 may have any appropriate configuration. As a more specific example, and as schematically illustrated in FIG. 2, valve assembly 130 may include a plurality of shower outlets distributed around drink outlet(s) 144. However, this is not required to all examples of closure assembly 100, and it is additionally within the scope of the present disclosure that the number of shower outlets 154 may be less than or equal to the number of drink outlets 144. As an example, valve assembly 130 may include an annular shower outlet 154 that encloses drink outlet(s) 144.

In an embodiment of closure assembly 100 in which valve assembly 130 includes a plurality of drink outlets 144 and/or a plurality of shower outlet 154, drink outlet(s) 144 and shower outlet(s) 154 may have any appropriate relative cumulative flow characteristics. As examples, a ratio of the sum of the drink outlet cross-sectional areas of each drink outlet 144 to the sum of the shower outlet cross-sectional areas of each shower outlet 154 may be at least 0.5, at least 1, at least 2, at least 5, at least 10, at least 15, at least 20, at most 30, at most 25, at most 17, at most 13, at most 7, at most 3, and/or at most 1.

Barrel valve 132 of valve assembly 130 may be configured to transition the valve assembly between the closed configuration, the drink configuration, and the shower configuration. For example, barrel valve 132 may be configured to be selectively rotated relative to closure base 110 about a rotational axis 102 of closure assembly 100. As schematically illustrated in FIGS. 1-2, rotational axis 102 may be a central axis of closure assembly 100, for example such that closure assembly 100 is at least substantially rotationally symmetric about rotational axis 102. Additionally or alternatively, and as schematically illustrated in FIG. 1, rotational axis 102 may be at least substantially parallel to a longitudinal axis 22 of liquid vessel 20 when closure base 110 is operatively coupled to neck 24 of liquid vessel 20.

Barrel valve 132 may be configured to rotate about rotational axis 102 in any appropriate manner. For example, barrel valve 132 may be configured to be selectively rotated about rotational axis 102 without concurrently translating along the rotational axis to transition valve assembly 130 between the closed configuration, the drink configuration, and the shower configuration. Stated differently, barrel valve 132 may be configured to be retained at a constant axial position along rotational axis 102 relative to closure base 110 when the valve assembly is selectively transitioned between the closed configuration, the drink configuration, and the shower configuration.

Barrel valve 132 and/or closure base 110 may have any appropriate structure for transitioning valve assembly 130 between the closed configuration, the drink configuration, and the shower configuration. For example, and as schematically illustrated on the right-hand side of the cut line in FIG. 1, barrel valve 132 may include at least one drink inlet 140 and a drink passage 142 such that drink passage 142 fluidly couples drink inlet(s) 140 and drink outlet(s) 144. In such an embodiment, closure base 110 may include at least one base port 124 configured to permit fluid flow through closure base 110 such that at least one base port 124 is at least partially aligned with a corresponding drink inlet 140 when valve assembly 130 is in the drink configuration. In such an embodiment, each base port 124 may be misaligned with each drink inlet 140 when valve assembly 130 is in the closed configuration.

Similarly, and as schematically illustrated on the left-hand side of the cut line in FIG. 1, barrel valve 132 may include at least one shower inlet 150 and a shower passage 152 such that shower passage 152 fluidly couples shower inlet(s) 150 and shower outlet(s) 154. In such an embodiment, at least one base port 124 may be at least partially aligned with a corresponding shower inlet 150 when valve assembly 130 is in the shower configuration. In such an embodiment, each base port 124 may be misaligned with each shower inlet 150 when valve assembly 130 is in the closed configuration.

As used herein, the terms "aligned," "partially aligned," and "fully aligned," as used to describe an arrangement of two or more ports, inlets, outlets, apertures, and the like, are used to describe a configuration in which the ports overlap in a manner that permits fluid to flow through each of the ports in sequence. Stated differently, two or more ports may be described as being aligned when the ports are arranged to permit fluid flow therethrough. More specifically, two or more ports may be described as being "fully aligned" when the ports overlap in such a manner as to maximize an area of overlap of the ports and/or to maximize a rate of fluid flow therethrough. By contrast, the term "misaligned," as used to describe two or more corresponding ports, is used to describe a configuration in which the ports do not overlap, such that fluid is restricted from flowing through the ports in sequence.

As schematically illustrated in FIG. 1, closure assembly 100 additionally or alternatively may include a self-sealing valve 170 positioned within and/or otherwise coupled to drink passage 142. In such an embodiment, self-sealing valve 170 may be configured to permit flow of the potable drink liquid through drink passage 142 and to drink outlet 144 only when a pressure of the potable drink liquid upon the self-sealing valve exceeds a predetermined threshold pressure.

For example, this threshold pressure may be a selected pressure differential between the interior and exterior sides of the valve, which may be predetermined and/or preselected by the design and materials of construction of the valve. The threshold may be exceeded, for example, by a user squeezing the liquid vessel to increase the pressure being imparted to the interior side of the valve and/or by a user sucking upon the drink outlet 144 and/or a mouthpiece (when present) to decrease the pressure imparted on the exterior side of the valve. As a more specific example, self-sealing valve 170 may include and/or be a slit diaphragm valve. An example of a suitable self-sealing valve 170 is disclosed in U.S. Pat. No. 5,439,143, the disclosure of which is incorporated by reference.

Each drink inlet 140 and/or each shower inlet 150 may be positioned and/or defined in any appropriate portion of barrel valve 132. As an example, and as schematically illustrated in FIG. 1, barrel valve 132 may include a barrel valve base 134 that extends at least substantially perpendicular to rotational axis 102. In such an embodiment, barrel valve base 134 may at least partially define each drink inlet 140 and/or may at least partially define each shower inlet 150.

In an embodiment of barrel valve 132 that includes drink passage 142 and shower passage 152, drink passage 142 and shower passage 152 may be fluidly separated from one another. Additionally or alternatively, each drink inlet 140 may be spaced apart from each shower inlet 150. Such configurations may ensure that the potable drink liquid is dispensed only via drink outlet(s) 144 when valve assembly 130 is in the drink configuration and that the potable drink liquid is dispensed only via shower outlet(s) 154 when valve assembly 130 is in the shower configuration.

In some examples of closure assembly 100, each base port 124 may be selectively aligned with drink inlet 140 when valve assembly 130 is in the drink configuration and may be selectively aligned with shower inlet 150 when valve assembly 130 is in the shower configuration. However, this is not required to all examples of closure assembly 100, and it is additionally within the scope of the present disclosure that each base port 124 may be configured to be aligned with a drink inlet 140 or a shower inlet 150. For example, and as schematically illustrated in FIG. 1, base ports 124 may include at least one base drink port 126 and at least one base shower port 128 such that each base drink port 126 is spaced apart from each base shower port 128. In such an embodiment, each base drink port 126 may be at least partially aligned with a corresponding drink inlet 140 when valve assembly 130 is in the drink configuration (schematically illustrated on the right-hand side of the cut line in FIG. 1), and each base shower port 128 may be at least partially aligned with a corresponding shower inlet 150 when valve assembly 130 is in the shower configuration (schematically illustrated on the left-hand side of the cut line in FIG. 1).

Barrel valve 132 may be operatively coupled to closure base 110 in any appropriate manner. As an example, and as schematically illustrated in FIG. 1, closure base 110 may include a basket portion 120 that extends into internal compartment 30 of liquid vessel 20 when closure base 110 is operatively coupled to neck 24 of liquid vessel 20, and barrel valve 132 may be at least partially received within basket portion 120. In such an embodiment, basket portion 120 may include base port(s) 124. More specifically, and as schematically illustrated in FIG. 1, basket portion 120 may include a basket base 122 that extends at least substantially perpendicular to rotational axis 102, and basket base 122 may define base port(s) 124. Additionally or alternatively, in an example of closure base 110 that includes basket portion 120, basket portion 120 may restrict fluid from flowing through each drink inlet 140 and through each shower inlet 150 of barrel valve 132.

Barrel valve 132 may be operatively coupled to basket portion 120 of closure base 110 in any appropriate manner. For example, barrel valve 132 may be operatively coupled to basket portion 120 such that barrel valve 132 is restricted from being removed from basket portion 120 without damaging closure assembly 110. As a more specific example, and as schematically illustrated in FIG. 1, barrel valve 132 and/or basket portion 120 may include a barrel valve retention structure 136 configured to restrict barrel valve 132 from being removed from basket portion 120. Barrel valve retention structure 136 may include and/or be any appropriate structure and/or mechanism, such as a structure that permits barrel valve 132 to rotate with respect to basket portion 120 without permitting removal of the barrel valve from the basket portion. Examples of barrel valve retention structure 136 include clips, detents, flanges, pins, and the like.

Valve assembly 130 may include and/or define each drink outlet 144 and each shower outlet 154 in any appropriate manner. As an example, and as schematically illustrated in FIGS. 1-2, valve assembly 130 may include an outlet spout 160 that defines each drink outlet 144. As a more specific example, and as further schematically illustrated in FIGS. 1-2, outlet spout 160 may include a nozzle 162 that extends away from closure base 110, and nozzle 162 may define each drink outlet 144. Outlet spout 160 additionally may define each shower outlet 154. However, this is not required to all examples of closure assembly 100, and it is additionally within the scope of the present disclosure that barrel valve 132 defines each shower outlet 154.

Outlet spout 160 may be a distinct structure that is operatively coupled to barrel valve 132. More specifically, outlet spout 160 may be configured to be selectively and repeatedly removed from and reattached to barrel valve 132 without damage to valve assembly 130. Such a configuration may facilitate cleaning and/or replacement of outlet spout 160, drink outlet(s) 144, and/or shower outlet(s) 154. In such a configuration, outlet spout 160 may be configured to be operatively coupled to barrel valve 132 via any appropriate coupling, such as a threaded coupling and/or a friction-fit coupling. Outlet spout 160 may be configured to remain coupled to barrel valve 132 while valve assembly 130 is transitioned between the closed configuration, the drink configuration, and the shower configuration. For example, outlet spout 160 may be configured to rotate with barrel valve 132 relative to closure base 110, and optionally about rotational axis 102, while valve assembly 130 is transitioned between the closed configuration, the drink configuration, and the shower configuration.

While each drink outlet 144 is spaced apart from each shower outlet 154, it also is within the scope of the present disclosure that closure assembly 100 may be configured to dispense the potable drink liquid via a common outlet when valve assembly 130 is in the drink configuration and in the shower configuration. In such an embodiment, each drink outlet 144 and each shower outlet 154 may be fluidly coupled to the common outlet, such as may be defined by valve assembly 130 and/or by outlet spout 160. Further, each drink outlet 144 and each shower outlet 154 may define relative orientations and/or angles at which drink fluid is emitted therefrom.

Valve assembly 130 may be configured to be selectively transitioned between the closed configuration, the drink configuration, and the shower configuration in any appropriate manner. As an example, and as schematically illustrated in FIGS. 1-2, valve assembly 130 may include an actuator 180 that is configured to be engaged by a user to selectively transition valve assembly 130 between the closed configuration, the drink configuration, and the shower configuration. As a more specific example, actuator 180 may be configured to rotate at least a portion of valve assembly 130, such as barrel valve 132, with respect to closure base 110 and about rotational axis 102 of closure assembly 100. In such an example, actuator 180 may be configured to rotate at least a portion of valve assembly 130 about rotational axis 102 without translating the portion of valve assembly 130 along rotational axis 102.

Valve assembly 130 may include and/or define actuator 180 in any appropriate manner. For example, and as schematically illustrated in FIGS. 1-2, barrel valve 132 may at least partially define actuator 180. In such an embodiment, and as further schematically illustrated in FIGS. 1-2, actuator 180 may include at least one actuator tab 182 that extends away from closure base 110. Additionally or alternatively, and as additionally schematically illustrated in FIGS. 1-2, outlet spout 160 may at least partially define actuator 180, such as in the form of at least one actuator recess defined in outlet spout 160.

Closure assembly 100 may be configured to provide a visual indication of the selected configuration of valve assembly 130. For example, and as best schematically illustrated in FIG. 2, closure assembly 100 may include a plurality of closure mode symbols 190. Each closure mode symbol may be configured to correspond to and/or represent a respective one of the closed configuration, the drink configuration, or the shower configuration. Closure assembly 100 additionally may include a closure mode indicator 192. In such an example, actuator 180 may be configured to selectively align closure mode indicator 192 with a corresponding closure mode symbol 190 to indicate whether valve assembly 130 in in the closed configuration, the drink configuration, or the shower configuration. Closure assembly 100 may include closure mode symbols 190 and/or closure mode indicator 192 in any appropriate manner. As an example, closure base 110 may include closure mode symbols 190 and valve assembly 130 may include closure mode indicator 192. In such an example, actuator 180 and/or actuator tab 182 may include closure mode indicator 192. Alternatively, closure base 110 may include closure mode indicator 192 and valve assembly 130 may include closure mode symbols 190.

Liquid vessels 20 according to the present disclosure are adapted to receive and hold or otherwise contain up to a predetermined volume of potable drink liquid for selective dispensing through the closure assembly, such as through drink outlet 144 or shower outlet 154 of closure assembly 100. Potable drink liquid may be selectively poured, or otherwise dispensed, into internal compartment 30 of the liquid vessel via neck 24. Potable drink liquid may be selectively dispensed from internal compartment 30 to a user from neck 24 when closure assembly 100 is not secured to the neck and/or when the closure assembly is in the drink configuration. It is within the scope of the present disclosure that neck 24 may (but is not required in all embodiments to) define the only opening through which potable drink liquid may be added to or removed from liquid vessel 20. As discussed in more detail herein, when closure assembly 100 is operatively coupled to liquid vessel 20, this selective dispensing of the drink liquid may be only through drink outlet 144 of the closure assembly when the valve assembly is in the drink configuration and/or through shower outlet 154 of the closure assembly when the valve assembly is in the shower configuration.

Liquid vessels 20 may have any suitable shape and may be formed from any suitable material or combination of materials to hold up to a predetermined volume of drink liquid. Examples of suitable sizes, or capacities, of liquid vessels 20 (i.e., volume of potable drink liquid able to be received into a liquid vessel at one time) include 4 ounces (oz.), 6 oz., 8 oz., 10 oz., 12 oz., 16 oz., 20 oz., 24 oz., 32 oz., 36 oz., 4-11 oz., 6-15 oz., 10-19 oz., 12-25 oz., 12-36 oz., 15-30 oz., 25-36 oz., 30-45 oz., 35-50 oz., and 10-70 oz. (with these examples referring to liquid (fluid) ounces of drink liquid that may be received at one time into an empty liquid container). It is within the scope of the present disclosure that liquid vessels having different sizes, including sizes that are smaller than, larger than, or within the illustrative sizes and/or ranges presented above, may be used without departing from the scope of the present disclosure.

An example of a material that may be used to construct liquid vessels 20 according to the present disclosure includes the TRITAN™ copolyester polymer developed by Eastman Chemical Company. Other examples of materials that may be suitable for construction of liquid vessels, or portions thereof, according to the present disclosure include polycarbonate, glass, plastic, and/or metal, such as aluminum or stainless steel. Further examples are disclosed in U.S. Pat. Nos. 7,533,783 and 8,905,252, the complete disclosures of which are hereby incorporated by reference.

Liquid vessels 20 may be (but are not required to be) rigid or at least semi-rigid and may include a bottom surface such that the liquid vessel may be generally self-supporting, or free-standing, when placed on a horizontal surface. In such embodiments, drink containers 10 may be referred to as drink bottles. As discussed herein, liquid vessels 20 also optionally may have a double-wall or other insulated construction. In some embodiments, a liquid vessel 20 according to the present disclosure may be constructed of polyethylene or other material that permits the liquid vessel to have a semi-rigid construction in which the liquid vessel may be reversibly (and nondestructively) collapsed during use. Such an example may permit opposing portions of the liquid vessel to be squeezed and/or otherwise urged from a nominal, or un-collapsed configuration, toward, or even into contact with, each other to reduce the volume of the liquid vessel and thereby aid in the dispensing of potable drink liquid therefrom. In such an embodiment, the liquid vessel may be configured to return automatically to its prior (nominal) configuration upon reduction of the force and/or pressure that was applied to urge the sides of the liquid vessel toward each other. Such embodiments may be described as squeeze bottles, as having a squeezable liquid vessel, and/or as having a resiliently deformable liquid vessel.

In other embodiments, a liquid vessel 20 according to the present disclosure may have a non-rigid, amorphous, and/or fully collapsible structure. In such an embodiment, the liquid vessel may not be configured to return automatically to its prior configuration upon reduction of the force and/or pressure that was applied to urge the sides of the liquid vessel toward each other, such as to dispense liquid from the liquid container through the closure assembly. For example, in such an embodiment, the liquid vessel may be configured to assume and maintain a configuration that is at least substantially flattened, collapsed, and/or deflated after the volume of the liquid vessel is reduced, such as by squeezing the liquid vessel and dispensing liquid from the liquid vessel through the closure assembly. Such embodiments may be described as flasks, soft flasks, flexible flasks, collapsible flasks, flexible water bottles, and/or collapsible water bottles.

As schematically illustrated in FIG. 1, nozzle 162 may extend away from closure base 110 by a nozzle height 164. Nozzle height 164 may be any suitable height, such as heights that are, or are similar to, the thickness of the material forming the upper surface of closure base 110, as well as lengths that are 2, 3, 4, 5, 10, or more times this thickness. Additional examples of suitable nozzle heights 164 include at least 1 millimeter (mm), at least 2 mm, at least 3 mm, at least 4 mm, at least 5 mm, at least 10 mm, at least 15 mm, at least 20 mm, at least 25 mm, at least 30 mm, at least 40 mm, at least 1-10 mm, at least 5-30 mm, at least 10-50 mm, less than 50 mm, less than 40 mm, less than 30 mm, less than 20 mm, less than 15 mm, less than 10 mm, and/or less than 5 mm. Drink outlet 144 and/or nozzle 162 may have any suitable size that is suitable for dispensing potable drink liquid from drink container 10 to a user's mouth. As examples, drink outlet 144 may have a drink outlet cross-sectional area (measured transverse to the long axis of the drink spout) that is at least 50 square millimeters ($mm^2$), at least 75 $mm^2$, at least 100 $mm^2$, at least 200 $mm^2$, at least 300 $mm^2$, at least 400 $mm^2$, at least 500 $mm^2$, at least 600 $mm^2$, at least 50-300 $mm^2$, at least 100-500 $mm^2$, at least 250-750 $mm^2$, less than 750 $mm^2$, less than 600 $mm^2$, less than 500 $mm^2$, less than 400 $mm^2$, less than 300 $mm^2$, and/or less than 200 $mm^2$.

In some embodiments, drink outlet 144, outlet spout 160, and/or nozzle 162 may define a structure that is configured to be received by a user's mouth. As examples, drink outlet 144, outlet spout 160, and/or nozzle 162 may be cylindrical, generally cylindrical, circular, elliptical, or may have any other suitable shape and/or cross-section, such as ergonomic shapes that facilitate comfortable engagement with a user's mouth for drinking potable drink liquid from drink container 10. Additionally or alternatively, and as schematically illustrated in FIG. 1, closure assembly 100 may include a mouthpiece 166 configured to be selectively and repeatedly attached to and removed from outlet spout 160 and/or nozzle 162. For example, mouthpiece 166 may be configured to be selectively and repeatedly attached to and removed from outlet spout 160 and/or nozzle 162, such as to provide a contact surface for engagement with a user's mouth that is washable and/or replaceable.

Outlet spout 160 and mouthpiece 166 each may be formed of any appropriate material. As examples, outlet spout 160 and mouthpiece 166 each may be formed of a rigid material, a flexible material, a resiliently deformable material, a polymer, and/or silicone. As a more specific example, outlet spout 160 may be formed of a rigid material, and mouthpiece 166 may be formed of a resiliently deformable material. As another example, outlet spout 160 and mouthpiece 166 each may be formed of a resiliently deformable material. In some embodiments, mouthpiece 166 may not include a valve or other structure for selectively restricting flow of liquid through the liquid outlet from the valve passage. In other embodiments, mouthpiece 166 may be a self-sealing mouthpiece that includes a self-sealing valve that selectively prevents liquid from being dispensed through the mouthpiece unless that valve has been configured from its nominal closed configuration to a dispensing configuration, such as by a user biting upon opposed sidewalls of the mouthpiece to urge the sidewalls toward each other. Examples of suitable bite-actuated mouthpieces 166 are disclosed in U.S. Pat. No. 7,533,783, the disclosure of which is incorporated by reference.

In some other embodiments, drink outlet 144, outlet spout 160, and/or nozzle 162 may not be configured to be received by a user's mouth. For example, in an embodiment in which actuator 180 includes actuator tab 182 extending away from closure base 110, actuator tab 182 may be configured to restrict, interfere with, and/or otherwise discourage direct engagement between the user's mouth and outlet spout 160. As more specific examples, and as schematically illustrated in FIG. 1, each actuator tab 182 may extend away from closure base 110 by an actuator tab height 184 that is at least 50% of nozzle height 164, at least 75% of nozzle height 164, at least 100% of nozzle height 164, at least 125% of nozzle height 164, at least 150% of nozzle height 164, at most 175% of nozzle height 164, at most 130% of nozzle height 164, at most 110% of nozzle height 164, at most 90% of nozzle height 164, and/or at most 70% of nozzle height 164.

Closure assemblies 100 according to the present disclosure may be adapted to be removably coupled to a liquid vessel 20 to cover, or otherwise enclose, the neck 24 thereof. When so coupled to liquid vessel 20, closure assembly 100 restricts drink liquid within internal compartment 30 of liquid vessel 20 from being dispensed from drink container 10 other than through drink outlet 144 and/or through shower outlet 154. When each drink outlet 144 and each shower outlet 154 is obstructed or otherwise closed or sealed, such as when valve assembly 130 is in the closed configuration, the closure assembly restricts potable drink liquid from being dispensed from liquid vessel 20. Accordingly, any potable drink liquid in internal compartment 30 of liquid vessel 20 is restricted from being dispensed to a user or otherwise removed from the liquid container until either closure assembly 100 is uncoupled from the liquid vessel or until the closure assembly is transitioned to the drink configuration or the shower configuration.

Closure assembly 100 is removably coupled to liquid vessel 20, such as to neck 24 thereof, to permit selective and non-destructive removal and replacement (i.e., repeated uncoupling and recoupling) of the closure assembly relative to the liquid vessel. For example, closure assembly 100 may be uncoupled from liquid vessel 20 to permit the liquid vessel to receive a volume of potable drink liquid, after which the closure assembly may be recoupled to the liquid container.

As schematically illustrated in FIG. 1, drink containers 10 according to the present disclosure may include a closure coupling mechanism 104 that is configured to selectively couple closure assembly 100 to liquid vessel 20. Closure coupling mechanism 104 may provide a liquid-tight connection between closure assembly 100 and liquid vessel 20. When such a connection is established between closure assembly 100 and liquid vessel 20, the closure assembly may restrict liquid from being dispensed from the drink container other than through drink outlet 144 and/or through shower outlet 154. Neck 24 and/or closure base 110 may include at least a portion of closure coupling mechanism 104. As a more specific example, closure coupling mechanism 104 may include threads on neck 24 and threads on closure base 110 that matingly engage one another to selectively couple closure assembly 100 to liquid vessel 20. Additional examples of closure coupling mechanism 104 that may be incorporated into drink containers 10 according to the present disclosure include (but are not limited to) snap-fit arrangements, friction-fit arrangements, clasp arrangements, etc.

As discussed, liquid vessel 20 may have an insulated construction. For example, and as schematically illustrated in FIG. 1, liquid vessel 20 may include an inner wall 40 that at least partially defines internal compartment 30 and an outer wall 42 that is spaced apart from the inner wall and is configured to be gripped by a user. In such an embodiment, liquid vessel 20 additionally may include an insulation layer 50 configured to restrict a transfer of heat energy through the liquid vessel, such as to maintain the potable drink liquid at a temperature that is lower or higher than an ambient temperature. When present, insulation layer 50 may be positioned between inner wall 40 and outer wall 42. Insulation layer 50 may be formed of any appropriate material, such as a foam and/or a metallic foil. As additional examples, insulation layer 50 may include and/or be a fluid, such as a liquid, a gas, air, and/or a fluid with a low thermal conductivity. Alternatively, in some embodiments, liquid vessel 20 may be an insulated vessel with inner wall 40 and outer wall 42 but without a distinct insulation layer 50 positioned between the inner wall and the outer wall. In such an embodiment, a space between inner wall 40 and outer wall 42 may be at least partially evacuated.

When present, insulation layer 50 may be formed and/or positioned within liquid vessel 20 in any appropriate manner. As examples, insulation layer 50 may be formed on inner wall 40 and/or on outer wall 42, or may be adhered to the inner wall and/or to the outer wall. Insulation layer 50 may be at least substantially opaque. Additionally or alternatively, insulation layer 50 may be at least partially optically transparent and/or optically translucent. As an example, and as schematically illustrated in FIG. 1, insulation layer 50 may include a liquid level indicator 52 configured to permit visual inspection of internal compartment 30 of liquid vessel 20 when closure assembly 100 is operatively coupled to the liquid vessel. More specifically, liquid level indicator 52 may be configured to permit visual inspection of the volume of the potable drink liquid within liquid vessel 20, such as to permit a user to determine how much liquid remains within the liquid vessel without removing closure assembly 100 from the liquid vessel.

Liquid level indicator 52 may include and/or be a region of an otherwise non-transparent and/or opaque insulation layer 50 that is at least partially optically transparent and/or optically translucent. Stated differently, insulation layer 50 may be at least substantially optically opaque in a portion of the insulation layer that does not include liquid level indicator 52. Additionally or alternatively, liquid level indicator 52 may include a plurality of distinct liquid level indicator features 54 defined in insulation layer 50. As examples, each liquid level indicator feature 54 may include and/or be an aperture defined by an otherwise opaque insulation layer 50. When present, the plurality of liquid level indicator features 54 may be distributed about a longitudinal extent of insulation layer 50 to permit visual inspection of a corresponding plurality of volumes of the potable drink liquid within liquid vessel 20. Stated differently, when the plurality of liquid level indicator features 54 is distributed about a longitudinal extent of insulation layer 50, the volume of potable drink liquid within liquid vessel 20 may be at least partially determined by observing (for example) an uppermost liquid level indicator feature 54 through which the potable drink liquid is visible when drink container 10 is maintained in an upright position. Additionally or alternatively, when present, the plurality of liquid level indicator features 54 may be distributed about an azimuthal (i.e., circumferential) extent of insulation layer 50. Such a configuration may facilitate inspection of the volume of the potable drink liquid within liquid vessel 20 from a plurality of distinct viewing angles. Additionally or alternatively, insulation layer 50 may include a plurality of liquid level indicator features 54 positioned on circumferentially opposed sides of the insulation layer. Such a configuration may permit light to pass through insulation layer 50 and/or internal compartment 30 of liquid vessel 20 via the liquid level indicator features on each of the circumferentially opposed sides, thereby facilitating viewing of the liquid level within the liquid vessel.

Each liquid level indicator feature 54 may have any appropriate form and/or shape. As examples, each liquid level indicator feature may have a shape that is a circle, an ellipse, a polygon, a triangle, a quadrilateral, a rectangle, a square, and/or other regular or irregular geometric shapes. In another embodiment, and as schematically illustrated in FIG. 1, liquid level indicator 52 and/or liquid level indicator feature 54 may include and/or be a liquid level indicator strip 56 extending along a longitudinal extent of the insulation layer. Additionally, liquid level indicator 52 and/or each liquid level indicator feature 54 may have any appropriate size. For example, liquid level indicator 52 and/or each liquid level indicator feature 54 may be sized so as to not substantially detract from a thermal insulation property of insulation layer 50. As a more specific example, insulation layer 50 may be at least substantially formed of a material with a thermal insulation that is quantified by a base R-value, and liquid level indicator 52 may be configured such that insulation layer 50 has an average R-value, as measured across a full surface area of the insulation layer. As examples, the average R-value of insulation layer 50 may be at least 70% of the base R-value, at least 80% of the base R-value, at least 90% of the base R-value, and/or at least 95% of the base R-value. The base R-value additionally or alternatively may be referred to as a predetermined R-value, a nominal R-value, and/or the R-value of the insulation layer 50 when the insulation layer does not include any liquid level indicator features 54.

Figure 3:
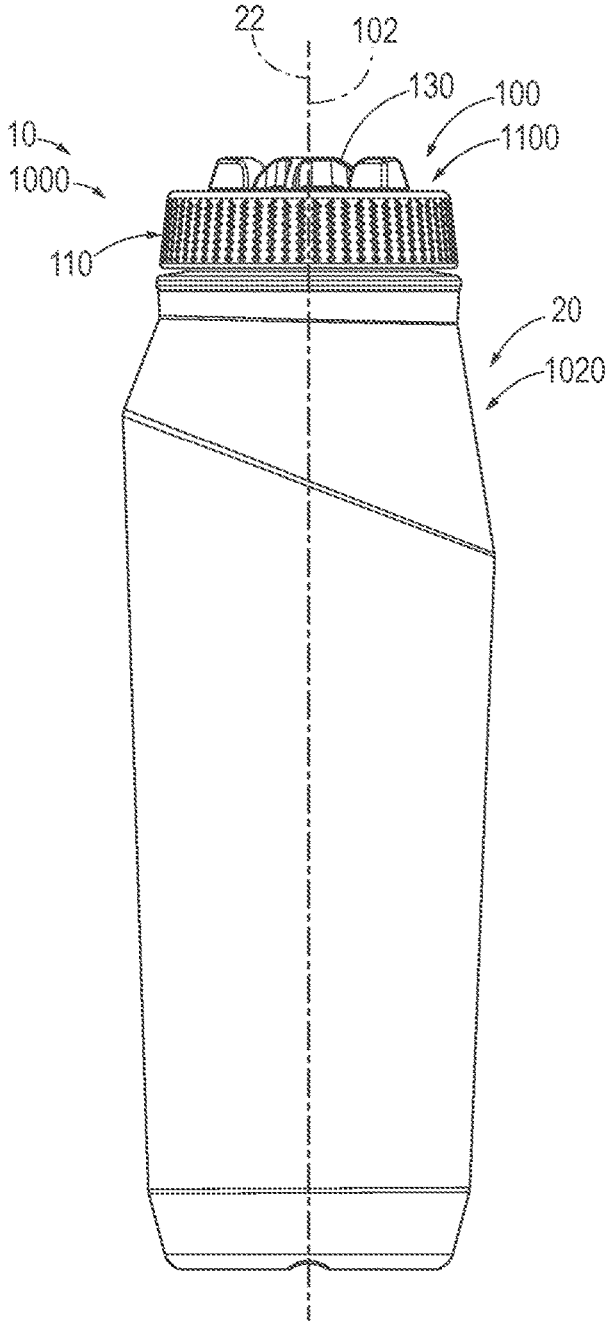
FIG. 3 is a side elevation view representing an example of a drink container with a closure assembly coupled to a liquid vessel according to the present disclosure.
Figure 4:
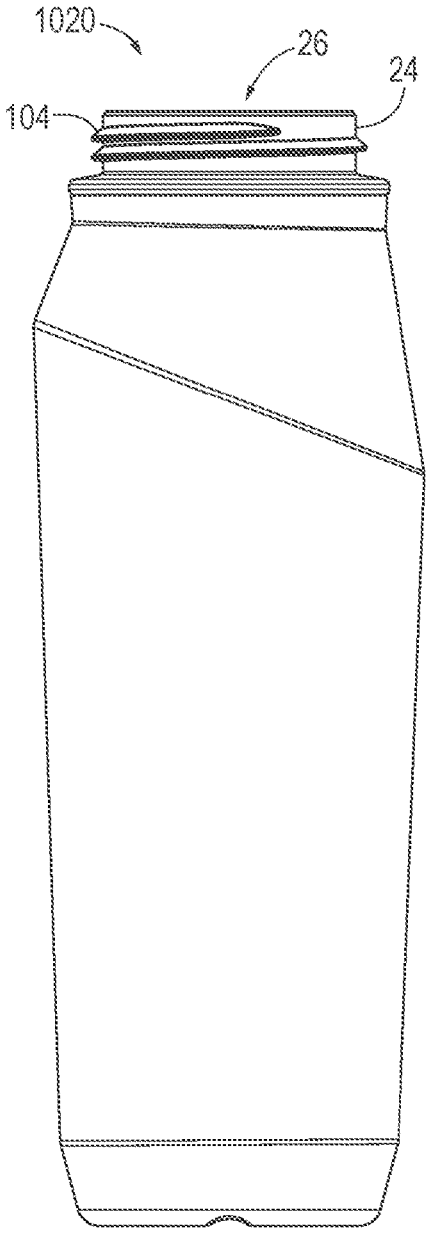
FIG. 4 is a side elevation view representing the liquid vessel of the drink container of FIG. 3.

Turning now to FIGS. 3-17, FIG. 3 illustrates a drink container 1000, which is an example of drink container 10. As illustrated in FIG. 3, drink container 1000 includes a closure assembly 1100, which is an example of closure assembly 100, coupled to neck 24 of a liquid vessel 1020, which is an example of liquid vessel 20. FIG. 4 illustrates liquid vessel 1020 in isolation. As illustrated in FIG. 4, drink container 1000 includes closure coupling mechanism 104 that includes threads defined on neck 24 of liquid vessel 1020 that mate with corresponding threads defined on closure base 110 of closure assembly 1100 (illustrated in FIGS. 8 and 10-15).

FIGS. 3-17 illustrate examples of drink containers 10, liquid vessels 20, and/or closure assemblies 100 with specific components, features, and/or options described above in the context of FIGS. 1-2. However, these examples are not limiting, and it is additionally within the scope of the present disclosure that the examples of FIGS. 3-17 additionally or alternatively may include any appropriate combination of components, features, properties, materials of construction, and/or options described herein, such as with respect to FIGS. 1-2.

FIGS. 5-15 illustrate closure assembly 1100 and/or components thereof in more detail. As illustrated in FIGS. 5-15, valve assembly 130 of closure assembly 1100 includes outlet spout 160 that is operatively coupled to barrel valve 132 via a threaded connection (visible in FIGS. 8-15). As best illustrated in FIGS. 10-15, valve assembly 130 of closure assembly 1100 is received within basket portion 120 of closure base 110. Closure assembly 1100 includes actuator 180 that is defined by barrel valve 132 and that includes a pair of opposed actuator tabs 182 (both actuator tabs 182 being visible in FIGS. 5-8). Outlet spout 160 of closure assembly 1100 includes a single drink outlet 144 and 8 shower outlets 154 distributed around drink outlet 144. Outlet spout 160 additionally includes nozzle 162 extending away from closure base 110 and defining drink outlet 144. Valve assembly 130 of closure assembly 1100 additionally includes self-sealing valve 170 positioned within drink passage 142.

Figure 5:
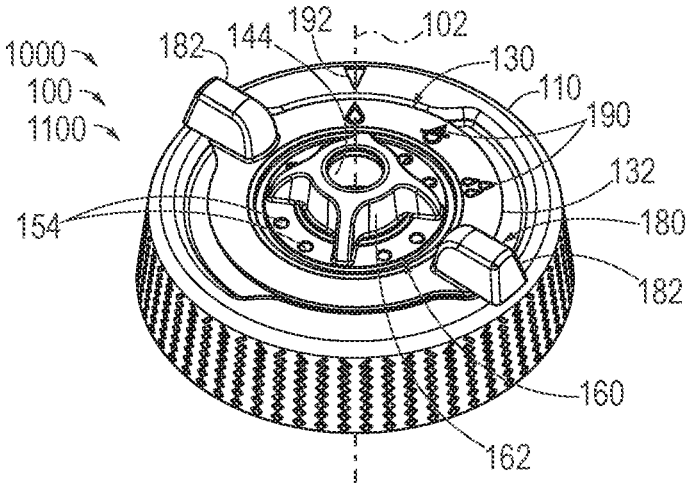
FIG. 5 is a top side isometric view representing the closure assembly of FIG. 3 in the drink configuration according to the present disclosure.
Figure 10:
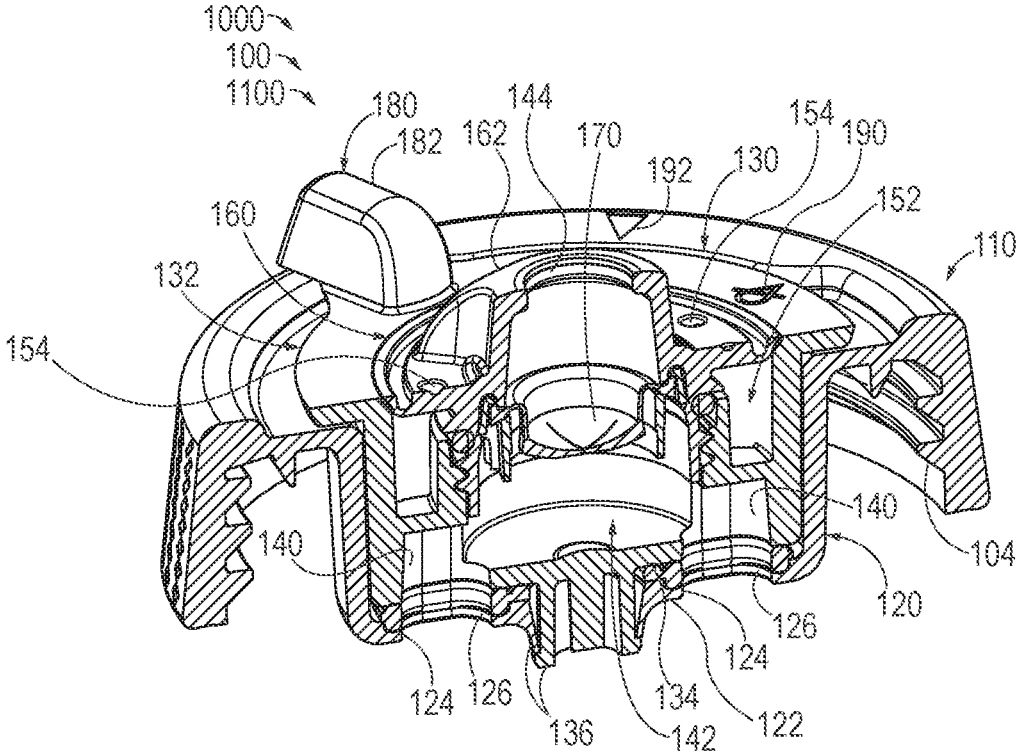
FIG. 10 is a cross-sectional top side isometric view representing the closure assembly of FIGS. 3 and 5-9 in the drink configuration.
Figure 11:
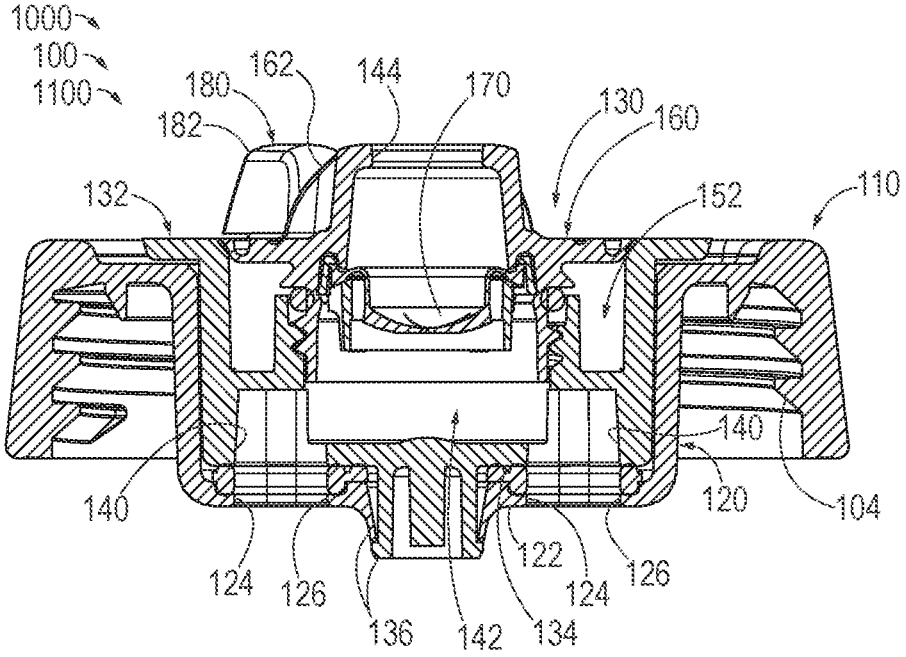
FIG. 11 is a cross-sectional side isometric view representing the closure assembly of FIGS. 3 and 5-10 in the drink configuration.

FIGS. 5 and 10-11 illustrate closure assembly 1100 in the drink configuration. As best illustrated in FIGS. 10-11, basket portion 120 of closure base 110 includes a pair of base drink ports 126 defined in basket base 122 of basket portion 120, and barrel valve 132 includes a pair of drink inlets 140 defined in barrel valve base 134. As illustrated in FIGS. 10-11, when valve assembly 130 of closure assembly 1100 is in the drink configuration, each base drink port 126 is aligned with a corresponding drink inlet 140 to permit the potable drink fluid to flow sequentially through closure base 110, drink passage 142, self-sealing valve 170, and drink outlet 144.

Figure 6:
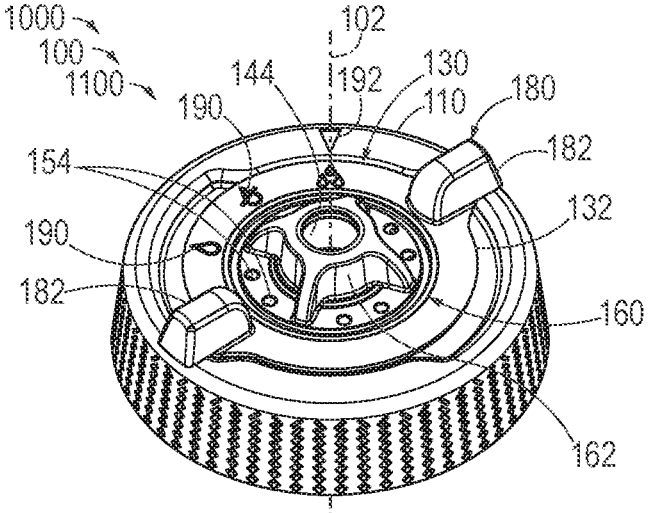
FIG. 6 is a top side isometric view representing the closure assembly of FIGS. 3 and 5 in the shower configuration according to the present disclosure.
Figure 12:
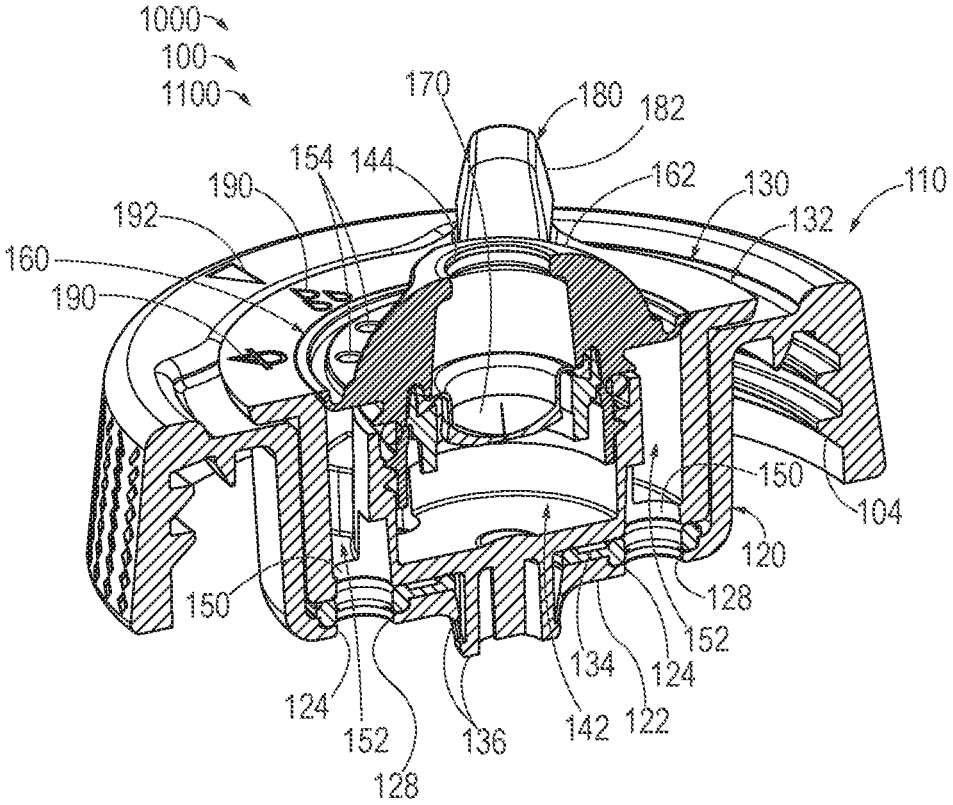
FIG. 12 is a cross-sectional top side isometric view representing the closure assembly of FIGS. 3 and 5-11 in the shower configuration.
Figure 13:
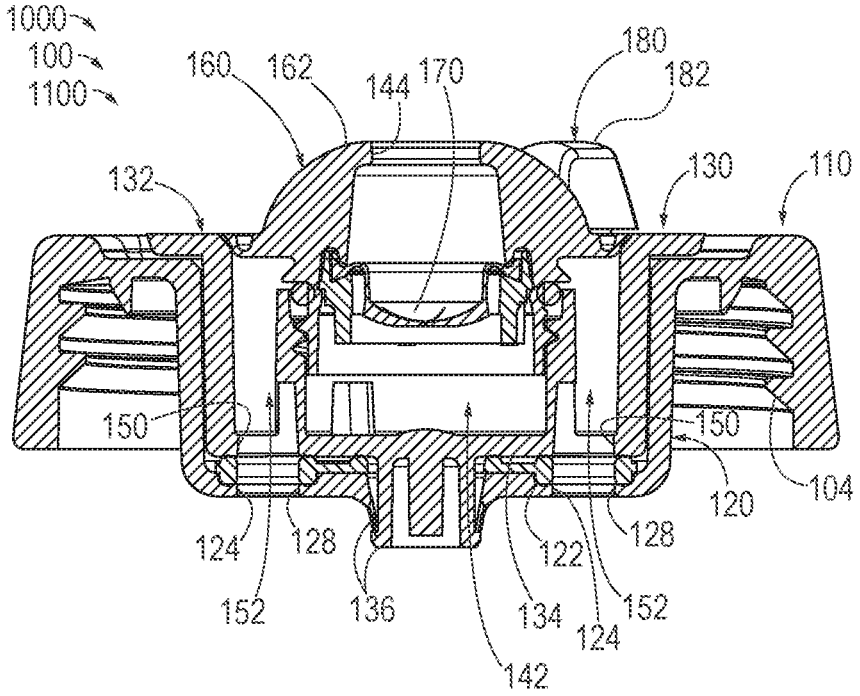
FIG. 13 is a cross-sectional side isometric view representing the closure assembly of FIGS. 3 and 5-12 in the shower configuration.

FIGS. 6 and 12-13 illustrate closure assembly 1100 in the shower configuration. As best illustrated in FIGS. 12-13, basket portion 120 of closure base 110 includes a pair of base shower ports 128 defined in basket base 122 of basket portion 120, and barrel valve 132 includes a pair of shower inlets 150 defined in barrel valve base 134. As illustrated in FIGS. 12-13, when valve assembly 130 of closure assembly 1100 is in the shower configuration, each base shower port 128 is aligned with a corresponding shower inlet 150 to permit the potable drink fluid to flow sequentially through closure base 110, shower passage 152, and each shower outlet 154 (illustrated in FIG. 6).

Figure 7:
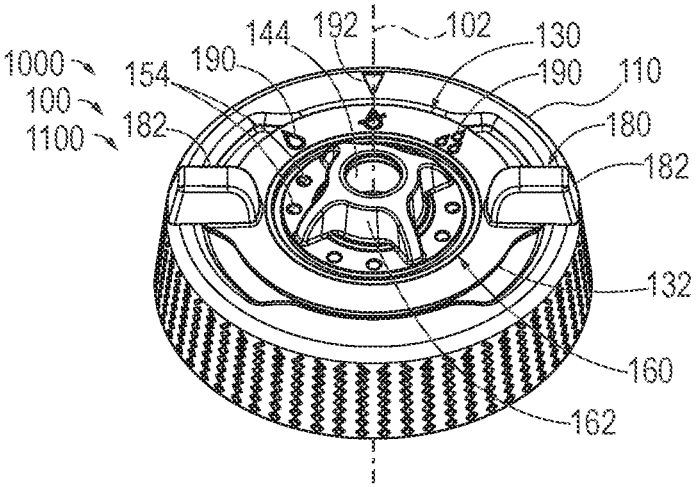
FIG. 7 is a top side isometric view representing the closure assembly of FIGS. 3 and 5-6 in the closed configuration according to the present disclosure.
Figure 8:
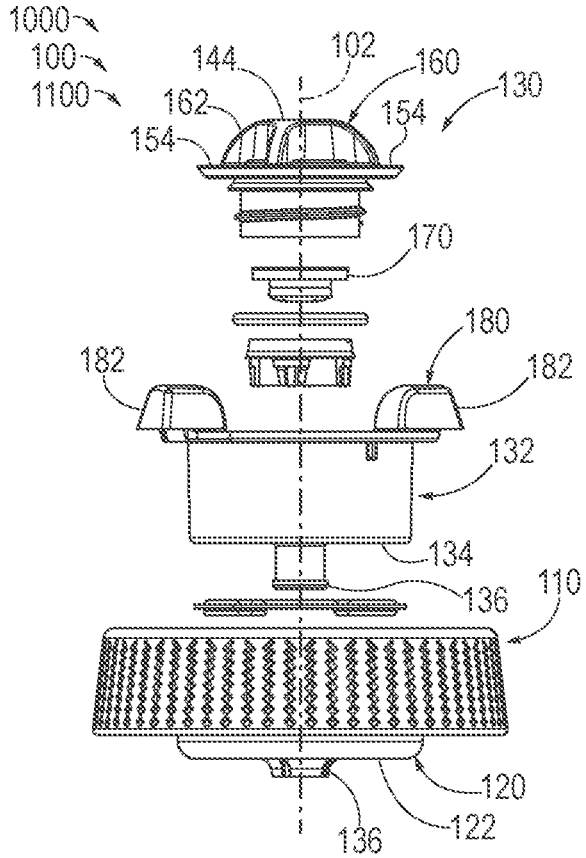
FIG. 8 is an exploded side elevation view representing the closure assembly of FIGS. 3 and 5-7.
Figure 9:
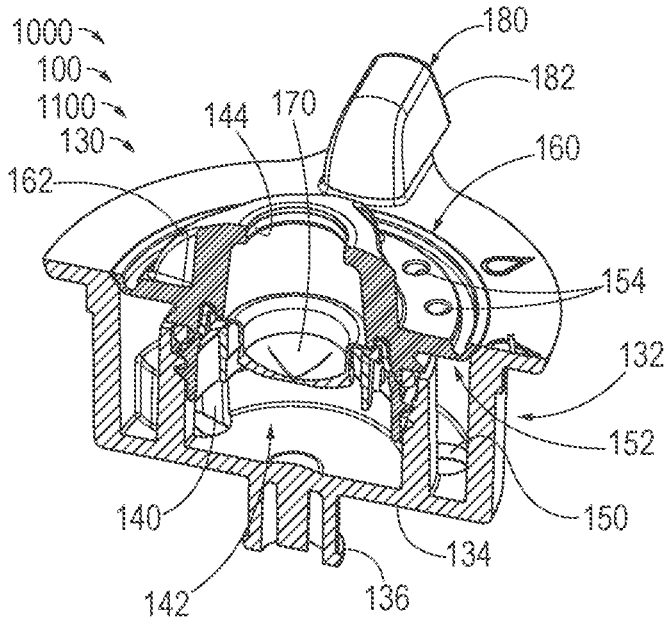
FIG. 9 is a cross-sectional top side isometric view representing the closure assembly of FIGS. 3 and 5-8.
Figure 14:
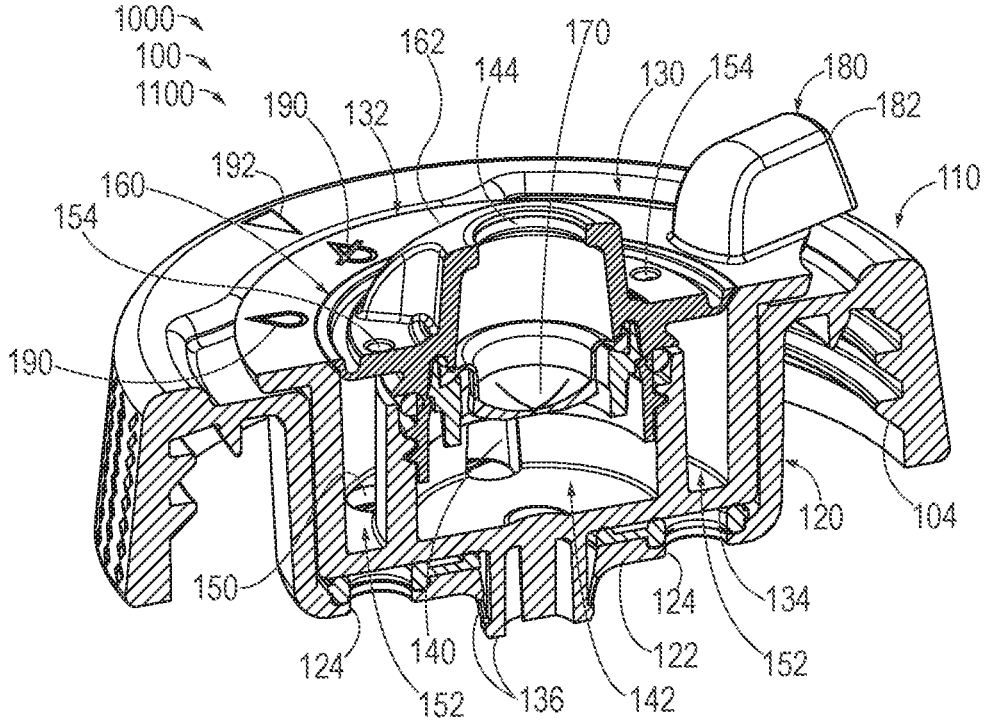
FIG. 14 is a cross-sectional top side isometric view representing the closure assembly of FIGS. 3 and 5-13 in the closed configuration.
Figure 15:
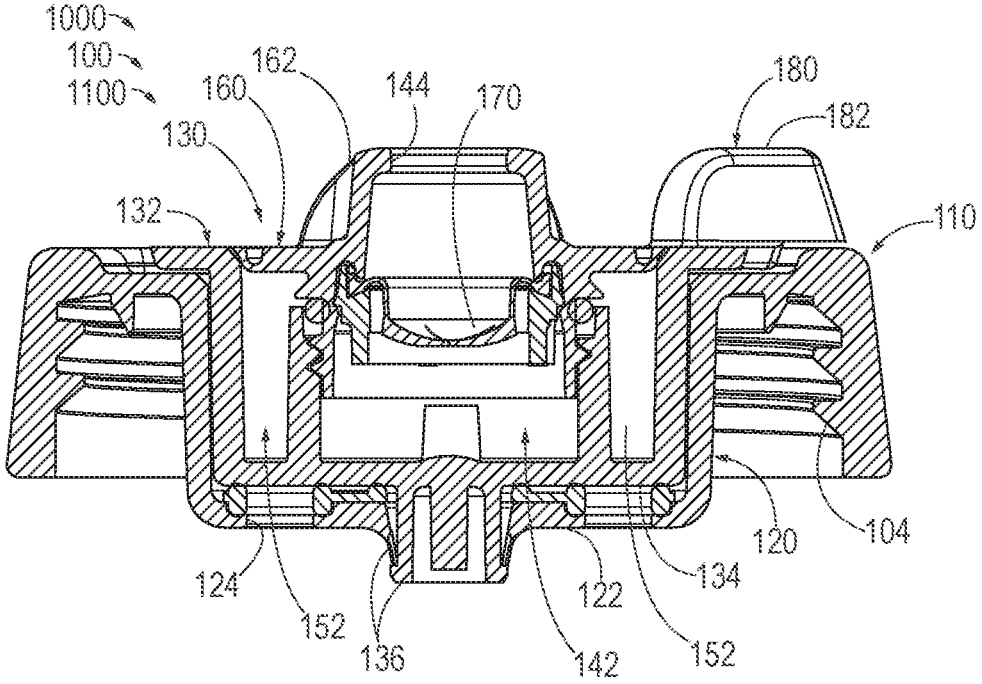
FIG. 15 is a cross-sectional side isometric view representing the closure assembly of FIGS. 3 and 5-14 in the closed configuration.

FIGS. 7 and 14-15 illustrate closure assembly 1100 in the closed configuration. As best illustrated in FIGS. 14-15 when valve assembly 130 of closure assembly 1100 is in the closed configuration, each base port 124 of basket portion 120 is misaligned with each drink inlet 140 and each shower inlet 150 of barrel valve 132. Thus, when valve assembly 130 of closure assembly 1100 is in the closed configuration, basket base 122 blocks each base port 124 to restrict the potable drink liquid from entering either of drink passage 142 and shower passage 152.

Figure 16:
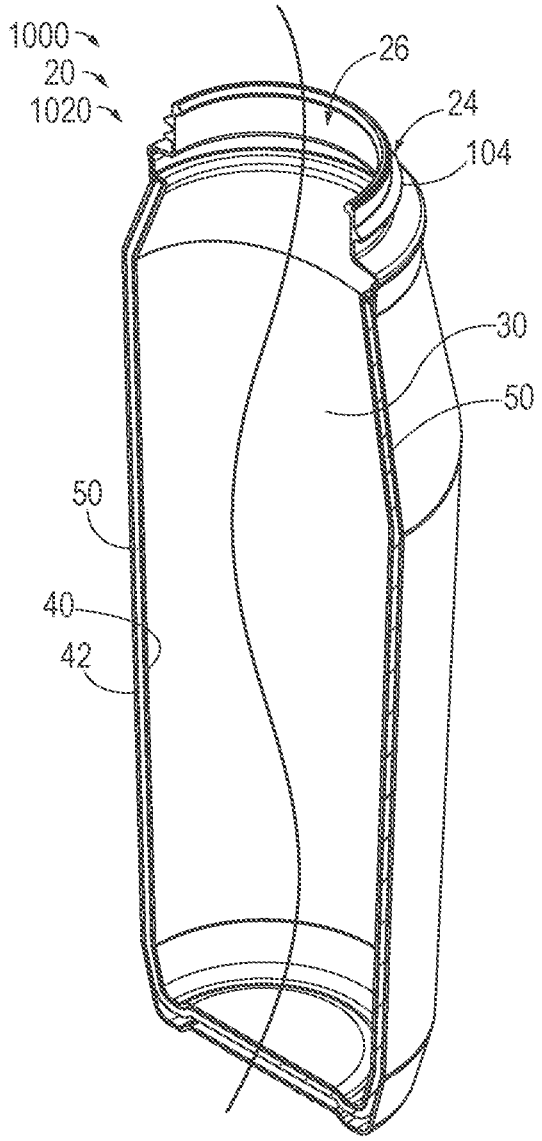
FIG. 16 is a cross-sectional top side isometric view representing examples of liquid vessels with insulation layers according to the present disclosure.
Figure 17:
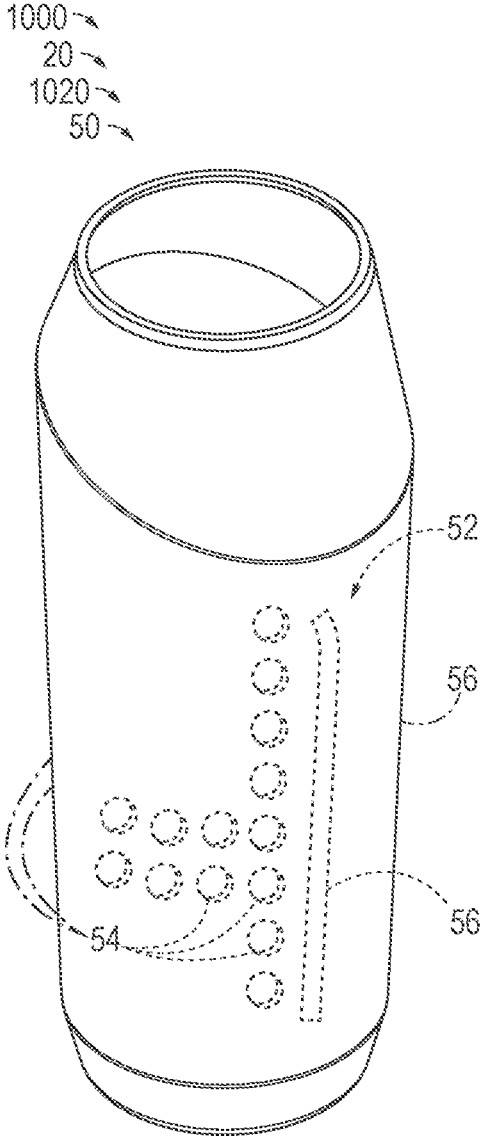
FIG. 17 is a top side isometric view representing examples of insulation layers of the liquid vessels of FIG. 16.

FIG. 16 is a cross-sectional view of examples of liquid vessel 1020 of FIGS. 3-4, and FIG. 17 illustrates examples of insulation layer 50 of liquid vessel 1020. As illustrated on the left-hand side of FIG. 16, liquid vessel 1020 may include insulation layer 50 in the form of a liquid, a gas, and/or a partially evacuated region between inner wall 40 and outer wall 42. Alternatively, and as illustrated on the right-hand side of FIG. 16, insulation layer 50 may include and/or be a solid structure positioned between inner wall 40 and outer wall 42.

FIG. 17 illustrates examples of insulation layers 50 of liquid vessel 1020 in the form of a solid structure and that includes liquid level indicator 52. As schematically illustrated in FIG. 17, liquid level indicator 52 of insulation layer 50 may include and/or be a plurality of liquid level indicator features 54, which may take the form of holes and/or apertures defined in the insulation layer. When present, and as schematically illustrated in FIG. 17, the plurality of liquid level indicator features 54 may be distributed about a longitudinal and/or azimuthal (i.e., circumferential) extent of insulation layer 50. Additionally or alternatively, and as further schematically illustrated in FIG. 17, liquid level indicator 52 may include and/or be liquid level indicator strip 56, which may take the form of a slit and/or cutout defined along a longitudinal extent of insulation layer 50. As illustrated schematically in dash-dot lines in FIG. 17, insulation layer 50 may include a plurality of liquid level indicator features 54 and/or liquid level indicator strips 56 positioned on opposite sides of the insulation layer, such as to permit light to pass through the insulation layer and/or internal compartment 30 of liquid vessel 20 via each of the circumferentially opposed sides.

Examples of closure assemblies, liquid vessels, and drink containers according to the present disclosure are presented in the following enumerated paragraphs.

A1.1. A closure assembly for a drink container that includes a liquid vessel having a neck with an opening and having an internal compartment configured to hold a volume of potable drink liquid, the closure assembly comprising:

a closure base configured to be selectively coupled to the neck of the liquid vessel to selectively couple the closure assembly to the liquid vessel; and a valve assembly operatively coupled to the closure base; wherein the valve assembly includes at least one drink outlet and at least one shower outlet; and wherein each drink outlet is spaced apart from each shower outlet;

wherein the valve assembly is configured to be selectively transitioned between a closed configuration, a drink configuration, and a shower configuration; wherein in the drink configuration, the valve assembly permits flow of the potable drink liquid from the internal compartment through the opening and to the at least one drink outlet and restricts flow of the potable drink liquid through the at least one shower outlet; wherein in the shower configuration, the valve assembly permits flow of the potable drink liquid from the internal compartment through the opening and to the at least one shower outlet and restricts flow of the potable drink liquid through the at least one drink outlet; and wherein in the closed configuration, the valve assembly restricts flow of the potable drink liquid from the internal compartment to each of the at least one drink outlet and the at least one shower outlet.

A1.2. The closure assembly of paragraph A1.1, wherein the closure base includes at least a portion of a closure coupling mechanism configured to selectively couple the closure assembly to the liquid vessel.

A2.1. The closure assembly of any of paragraphs A1.1-A1.2, wherein the valve assembly includes a barrel valve configured to selectively transition the valve assembly between the closed configuration, the drink configuration, and the shower configuration.

A2.2. The closure assembly of paragraph A2.1, wherein the barrel valve is configured to be selectively rotated relative to the closure base to transition the valve assembly between the closed configuration, the drink configuration, and the shower configuration.

A2.3. The closure assembly of paragraph A2.2, wherein the barrel valve is configured to be selectively rotated about a rotational axis of the closure assembly.

A2.4. The closure assembly of paragraph A2.3, wherein the rotational axis is a central axis of the closure assembly.

A2.5. The closure assembly of any of paragraphs A2.3-A2.4, wherein the closure assembly is at least substantially, and optionally fully, rotationally symmetric about the rotational axis.

A2.6. The closure assembly of any of paragraphs A2.3-A2.5, wherein the rotational axis is at least substantially, and optionally fully, parallel to a longitudinal axis of the liquid vessel when the closure base is operatively coupled to the neck of the liquid vessel.

A2.7. The closure assembly of any of paragraphs A2.3-A2.6, wherein the barrel valve is configured to be selectively rotated about the rotational axis without concurrently translating along the rotational axis to transition the valve assembly between the closed configuration, the drink configuration, and the shower configuration.

A2.8. The closure assembly of any of paragraphs A2.3-A2.7, wherein the barrel valve is configured to be retained at a constant axial position along the rotational axis relative to the closure base when the valve assembly is selectively transitioned between the closed configuration, the drink configuration, and the shower configuration.

A2.9. The closure assembly of any of paragraphs A2.1-A2.8, wherein the barrel valve includes at least one drink inlet and a drink passage, and wherein the drink passage fluidly couples the at least one drink inlet and the at least one drink outlet.

A2.10. The closure assembly of paragraph A2.9, wherein the barrel valve includes a barrel valve base that extends at least substantially, and optionally fully, perpendicular to a/the rotational axis, and wherein the barrel valve base at least partially, and optionally fully, defines the at least one drink inlet.

A2.11. The closure assembly of any of paragraphs A2.9-A2.10, wherein the closure base includes at least one base port configured to permit fluid to flow through the closure base, and wherein the at least one base port is at least partially, and optionally fully, aligned with a corresponding drink inlet of the at least one drink inlet when the valve assembly is in the drink configuration.

A2.12. The closure assembly of paragraph A2.11, wherein each base port is misaligned with each drink inlet when the valve assembly is in the closed configuration.

A2.13. The closure assembly of any of paragraphs A2.1-A2.12, wherein the barrel valve includes at least one shower inlet and a shower passage, and wherein the shower passage fluidly couples the at least one shower inlet and the at least one shower outlet.

A2.14. The closure assembly of paragraph A2.13, wherein the barrel valve includes a/the barrel valve base that extends at least substantially, and optionally fully perpendicular to a/the rotational axis, and wherein the barrel valve base at least partially, and optionally fully, defines the at least one shower inlet.

A2.15. The closure assembly of any of paragraphs A2.13-A2.14, wherein the closure base includes a/the at least one base port configured to permit fluid to flow through the closure base, and wherein the at least one base port is at least partially, and optionally fully, aligned with a corresponding shower inlet of the at least one shower inlet when the valve assembly is in the shower configuration.

A2.16. The closure assembly of paragraph A2.15, wherein each base port is misaligned with each shower inlet when the valve assembly is in the closed configuration.

A2.17. The closure assembly of any of paragraphs A2.13-A2.16, when dependent from paragraph A2.11, wherein the at least one base port includes at least one base drink port and at least one base shower port; wherein each base drink port is at least partially, and optionally fully, aligned with a corresponding drink inlet of the at least one drink inlet when the valve assembly is in the drink configuration; wherein each base shower port is at least partially, and optionally fully, aligned with a corresponding shower inlet of the at least one shower inlet when the valve assembly is in the shower configuration; and wherein each base drink port is spaced apart from each base shower port.

A2.18. The closure assembly of paragraph A2.13, when dependent from paragraph A2.9, wherein the drink passage and the shower passage are fluidly separated from one another.

A2.19. The closure assembly of paragraph A2.13, when dependent from paragraph A2.9, wherein each drink inlet is spaced apart from each shower inlet.

A2.20. The closure assembly of any of paragraphs A2.1-A2.19, wherein, when the valve assembly is in the closed configuration, the closure base restricts fluid from flowing through the barrel valve.

A2.21. The closure assembly of any of paragraphs A2.1-A2.20, wherein the closure base includes a basket portion that extends into the internal compartment of the liquid vessel when the closure base is operatively coupled to the neck of the liquid vessel, and wherein the barrel valve is at least partially, and optionally fully, received within the basket portion.

A2.22. The closure assembly of paragraph A2.21, wherein the basket portion includes a/the at least one base port.

A2.23. The closure assembly of paragraph A2.22, wherein the basket portion includes a basket base that extends at least substantially, and optionally fully, perpendicular to a/the rotational axis, and wherein the basket base defines the at least one base port.

A2.24. The closure assembly of any of paragraphs A2.21-A2.23, wherein, when the valve assembly is in the closed configuration, the basket portion restricts fluid from flowing through each of a/the at least one drink inlet and a/the at least one shower inlet of the barrel valve.

A2.25. The closure assembly of paragraph A2.21, wherein the barrel valve is operatively coupled to the basket portion such that the barrel valve is restricted from being removed from the basket portion without damaging the closure assembly.

A2.26. The closure assembly of paragraph A2.25, wherein at least one of the barrel valve and the basket portion includes a barrel valve retention structure configured to restrict the barrel valve from being removed from the basket portion.

A2.27. The closure assembly of paragraph A2.26, wherein the barrel valve retention structure is configured to permit the barrel valve to rotate with respect to the basket portion.

A2.28. The closure assembly of any of paragraphs A2.9-A2.27, wherein the valve assembly includes a self-sealing valve positioned within the drink passage, wherein the self-sealing valve is configured to permit flow of the potable drink liquid through the drink passage and to the drink outlet only when a pressure of the potable drink liquid upon the self-sealing valve exceeds a predetermined threshold pressure.

A2.29. The closure assembly of paragraph A2.28, wherein the self-sealing valve includes, and optionally is, a slit diaphragm valve.

A3.1. The closure assembly of any of paragraphs A1.1-A2.29, wherein each drink outlet has a drink outlet cross-sectional area, wherein each shower outlet has a shower outlet cross-sectional area, and wherein each drink outlet cross-sectional area is at least one of at least 2 times each shower outlet cross-sectional area, at least 5 times each shower outlet cross-sectional area, at least 10 times each shower outlet cross-sectional area, at least 20 times each shower outlet cross-sectional area, at most 30 times each shower outlet cross-sectional area, at most 15 times each shower outlet cross-sectional area, at most 7 times each shower outlet cross-sectional area, and at most 3 times each shower outlet cross-sectional area.

A3.2. The closure assembly of any of paragraphs A1.1-A3.1, wherein each drink outlet has a/the drink outlet cross-sectional area, wherein each shower outlet has a/the shower outlet cross-sectional area, and wherein a ratio of the sum of the drink outlet cross-sectional areas of each drink outlet to the sum of the shower outlet cross-sectional areas of each shower outlet is at least one of at least 0.5, at least 1, at least 2, at least 5, at least 10, at least 15, at least 20, at most 30, at most 25, at most 17, at most 13, at most 7, at most 3, and at most 1.

A3.3. The closure assembly of any of paragraphs A1.1-A3.2, wherein the valve assembly is configured to permit flow of the potable drink liquid through each of the at least one drink outlet at a drink flow rate when the valve assembly is in the drink configuration, wherein the valve assembly is configured to permit flow of the potable drink liquid through each of the at least one shower outlet at a shower flow rate when the valve assembly is in the shower configuration, and wherein the drink flow rate is greater than the shower flow rate.

A3.4. The closure assembly of paragraph A3.3, wherein the drink flow rate is at least one of at least 1.5 times the shower flow rate, at least 2 times the shower flow rate, at least 5 times the shower flow rate, at least 10 times the shower flow rate, at least 20 times the shower flow rate, at most 50 times the shower flow rate, at most 30 times the shower flow rate, at most 15 times the shower flow rate, at most 7 times the shower flow rate, and at most 3 times the shower flow rate.

A3.5. The closure assembly of any of paragraphs A1.1-A3.4, wherein the valve assembly is configured to permit flow of the potable drink liquid through each of the at least one drink outlet at a drink stream velocity when the valve assembly is in the drink configuration, wherein the valve assembly is configured to permit flow of the potable drink liquid through each of the at least one shower outlet at a shower stream velocity when the valve assembly is in the shower configuration, and wherein the shower stream velocity is greater than the drink stream velocity.

A3.6. The closure assembly of paragraph A3.5, wherein the shower stream velocity is at least one of at least 1.5 times the drink stream velocity, at least 2 times the drink stream velocity, at least 5 times the drink stream velocity, at least 10 times the drink stream velocity, at least 20 times the drink stream velocity, at most 50 times the drink stream velocity, at most 30 times the drink stream velocity, at most 15 times the drink stream velocity, at most 7 times the drink stream velocity, and at most 3 times the drink stream velocity.

A3.7. The closure assembly of any of paragraphs A1.1-A3.6, wherein the at least one drink outlet includes at least one of 1 drink outlet, at least 2 drink outlets, at least 3 drink outlets, and fewer than 5 drink outlets.

A3.8. The closure assembly of any of paragraphs A1.1-A3.7, wherein the at least one shower outlet includes 1 shower outlet, at least 2 shower outlets, at least 5 shower outlets, at least 10 shower outlets, at least 20 shower outlets, fewer than 30 shower outlets, fewer than 15 shower outlets, fewer than 7 shower outlets, and fewer than 3 shower outlets.

A3.9. The closure assembly of any of paragraphs A1.1-A3.8, wherein the number of shower outlets is greater than the number of drink outlets.

A3.10. The closure assembly of any of paragraphs A1.1-A3.9, wherein the at least one shower outlet includes an annular shower outlet that encloses the at least one drink outlet.

A3.11. The closure assembly of any of paragraphs A1.1-A3.10, wherein the at least one shower outlet includes a plurality of shower outlets distributed around the at least one drink outlet.

A4.1. The closure assembly of any of paragraphs A1.1-A3.11, wherein the valve assembly includes an outlet spout that defines each drink outlet.

A4.2. The closure assembly of paragraph A4.1, wherein the outlet spout is operatively coupled to a/the barrel valve.

A4.3. The closure assembly of paragraph A4.2, wherein the outlet spout is configured to be selectively and repeatedly removed from the barrel valve and reattached to the barrel valve without damage to the valve assembly.

A4.4. The closure assembly of any of paragraphs A4.2-A4.3, wherein the outlet spout is configured to be operatively coupled to the barrel valve via at least one of a threaded coupling and a friction-fit coupling.

A4.5. The closure assembly of any of paragraphs A4.2-A4.4, wherein the outlet spout is configured to remain coupled to the barrel valve while the valve assembly is transitioned between the closed configuration, the drink configuration, and the shower configuration.

A4.6. The closure assembly of paragraph A4.5, wherein the outlet spout is configured to rotate with the barrel valve relative to the closure base and about a/the rotational axis while the valve assembly is transitioned between the closed configuration, the drink configuration, and the shower configuration.

A4.7. The closure assembly of any of paragraphs A4.1-A4.6, wherein the outlet spout includes a nozzle that extends away from the closure base.

A4.8. The closure assembly of paragraph A4.7, wherein the nozzle defines each drink outlet.

A4.9. The closure assembly of any of paragraphs A4.1-A4.8, wherein the closure assembly further includes a mouthpiece configured to be selectively and repeatedly attached to and removed from the outlet spout.

A4.10. The closure assembly of paragraph A4.9, wherein the mouthpiece is configured to be selectively and repeatedly attached to and removed from a/the nozzle of the outlet spout.

A4.11. The closure assembly of any of paragraphs A4.9-A4.10, wherein the mouthpiece is formed of a resiliently deformable material.

A4.12. The closure assembly of any of paragraphs A4.1-A4.11, wherein the outlet spout defines each shower outlet.

A4.13. The closure assembly of any of paragraphs A2.1-A4.11, wherein the barrel valve defines each shower outlet.

A5.1. The closure assembly of any of paragraphs A1.1-A4.13, wherein the valve assembly further includes an actuator configured to be engaged by a user to selectively transition the valve assembly between the closed configuration, the drink configuration, and the shower configuration.

A5.2. The closure assembly of paragraph A5.1, wherein the actuator is configured to rotate at least a portion of the valve assembly with respect to the closure base and about a/the rotational axis of the closure assembly.

A5.3. The closure assembly of paragraph A5.2, wherein the actuator is configured to rotate the portion of the valve assembly without translating the portion of the valve assembly along the rotational axis.

A5.4. The closure assembly of any of paragraphs A5.1-A5.3, wherein one of the valve assembly and the closure base includes a plurality of closure mode symbols, wherein the other of the valve assembly and the closure base includes a closure mode indicator, and wherein the actuator is configured to selectively align the closure mode indicator with a corresponding closure mode symbol, wherein each closure mode symbol corresponds to one of the closed configuration, the drink configuration, and the shower configuration.

A5.5. The closure assembly of paragraph A5.4, wherein the actuator includes the closure mode indicator.

A5.6. The closure assembly of any of paragraphs A5.1-A5.5, when dependent from paragraph A2.1, wherein the barrel valve at least partially, and optionally fully, defines the actuator.

A5.7. The closure assembly of any of paragraphs A51-A5.6, wherein the actuator includes at least one actuator tab that extends away from the closure base.

A5.8. The closure assembly of paragraph A5.7, wherein the at least one actuator tab includes a/the closure mode indicator.

A5.9. The closure assembly of any of paragraphs A5.7-A5.8, wherein each actuator tab extends away from the closure base by an actuator tab height, wherein a/the nozzle extends away from the closure base by a nozzle height, and wherein the actuator tab height is at least one of at least 50% of the nozzle height, at least 75% of the nozzle height, at least 100% of the nozzle height, at least 125% of the nozzle height, at least 150% of the nozzle height, at most 175% of the nozzle height, at most 130% of the nozzle height, at most 110% of the nozzle height, at most 90% of the nozzle height, and at most 70% of the nozzle height.

A5.10. The closure assembly of any of paragraphs A5.1-A5.9, when dependent from paragraph A4.1, wherein the outlet spout at least partially, and optionally fully, defines the actuator.

A5.11. The closure assembly of paragraph A5.10, wherein the actuator includes at least one actuator recess defined in the outlet spout.

B1.1. A drink container, comprising:

a liquid vessel having a neck with an opening and having an internal compartment configured to hold a volume of potable drink liquid; and the closure assembly of any of paragraphs A1.1-A5.11 configured to be operatively coupled to the liquid vessel.

B1.2. The drink container of paragraph B1.1, wherein the liquid vessel is a semi-rigid liquid vessel configured to be squeezed by a user to expel the potable drink liquid through the closure assembly.

B1.3. The drink container of any of paragraphs B1.1-B1.2, wherein the neck includes at least a portion of a/the closure coupling mechanism configured to selectively couple the closure assembly to the liquid vessel.

B1.4. The drink container of paragraph B1.3, wherein the closure coupling mechanism includes threads on the neck and threads on the closure base that matingly engage one another to selectively couple the closure assembly to the liquid vessel.

B2.1. The drink container of any of paragraphs B1.1-B1.4, wherein the liquid vessel includes an inner wall that at least partially, and optionally fully, defines the internal compartment and an outer wall configured to be gripped by a user.

B2.2. The drink container of any of paragraphs B1.1-B2.1, wherein the liquid vessel includes an insulation layer configured to restrict a transfer of heat energy through the liquid vessel.

B2.3. The drink container of paragraph B2.2, wherein the insulation layer includes at least one of a foam, a metallic foil, a fluid, a gas, and a liquid.

B2.4. The drink container of any of paragraphs B2.2-B2.3, wherein the insulation layer is positioned between a/the inner wall and a/the outer wall.

B2.5. The drink container of any of paragraphs B2.2-B2.4, wherein the insulation layer is formed on at least one of a/the inner wall and a/the outer wall.

B2.6. The drink container of any of paragraphs B2.2-B2.4, wherein the insulation layer is adhered to at least one of a/the inner wall and a/the outer wall.

B2.7. The drink container of any of paragraphs B2.2-B2.6, wherein the insulation layer is at least one of optically transparent and optically translucent.

B2.8. The drink container of any of paragraphs B2.2-B2.6, wherein the insulation layer is at least substantially, and optionally fully, opaque.

B2.9. The drink container of any of paragraphs B2.2-B2.8, wherein the insulation layer includes a liquid level indicator configured to permit visual inspection of the internal compartment when the closure assembly is operatively coupled to the liquid vessel.

B2.10. The drink container of paragraph B2.9, wherein the liquid level indicator is configured to permit visual inspection of the volume of the potable drink liquid within the internal compartment.

B2.11. The drink container of any of paragraphs B2.9-B2.10, wherein the liquid level indicator is at least one of optically transparent and optically translucent.

B2.12. The drink container of any of paragraphs B2.9-B2.11, wherein the liquid level indicator includes a plurality of liquid level indicator features defined in the insulation layer.

B2.13. The drink container of paragraph B2.12, wherein each liquid level indicator feature includes an aperture defined by the insulation layer.

B2.14. The drink container of any of paragraphs B2.12-B2.13, wherein the plurality of liquid level indicator features are distributed about a longitudinal extent of the insulation layer to permit visual inspection of each of a plurality of volumes of the potable drink liquid within the liquid vessel.

B2.15. The drink container of any of paragraphs B2.12-B2.14, wherein the plurality of liquid level indicator features are distributed about an azimuthal extent of the insulation layer to facilitate visual inspection of the volume of the potable drink liquid within the liquid vessel from a plurality of viewing angles.

B2.16. The drink container of any of paragraphs B2.12-B2.15, wherein each liquid level indicator feature has a shape that includes at least one of a circle, an ellipse, a polygon, a triangle, a quadrilateral, a rectangle, and a square.

B2.17. The drink container of any of paragraphs B2.9-B2.16, wherein the liquid level indicator includes at least one liquid level indicator strip extending along a longitudinal extent of the insulation layer.

B2.18. The drink container of any of paragraphs B2.2-B2.17, wherein the insulation layer is at least substantially formed of a material with a thermal insulation that is quantified by a base R-value; wherein a/the liquid level indicator is configured such that the insulation layer has an average R-value, as measured across a full surface area of the insulation layer; and wherein the average R-value of the insulation layer is at least one of at least 70% of the base R-value, at least 80% of the base R-value, at least 90% of the base R-value, and at least 95% of the base R-value.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a drink container according to the present disclosure, means that the specified action, movement, configuration, or other activity is a direct or indirect result of user manipulation of an aspect of, or one or more components of, the drink container.

As used herein, "operative" and "operatively," when modifying an action, movement, configuration, interconnection, coupling, or other relationship of one or more components of a drink container according to the present disclosure, means that the specified action, movement, configuration, interconnection, coupling or other relationship is performed and/or achieved as a result of standard (i.e., intended) operation and/or functional utilization of the one or more components of the drink container, such as in a manner described herein.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase "at least substantially," when used with reference to a property of one or more components, features, details, structures, embodiments, and/or methods according to the present disclosure, is intended to encompass components, features, details, structures, embodiments, and/or methods that predominantly and/or fully exhibit the property. Stated differently, as used herein, the phrase "at least substantially" is intended to be equivalent to the phrase "at least substantially, and optionally fully."

As used herein, the phrase "at least partially," when used with reference to a property of one or more components, features, details, structures, embodiments, and/or methods according to the present disclosure, is intended to encompass components, features, details, structures, embodiments, and/or methods that partially, substantially, and/or fully exhibit the property. Stated differently, as used herein, the phrase "at least partially" is intended to be equivalent to the phrase "at least partially, and optionally fully."

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

INDUSTRIAL APPLICABILITY

The drink closures and drink containers disclosed herein are applicable to the beverage container industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A fluid container, comprising:

a fluid vessel having a neck with an opening and having an internal compartment sized to hold a volume of fluid, the internal compartment being at least partially enclosed by an insulation layer positioned between an inner wall and outer wall of the fluid container;

a closure assembly removably coupled to the fluid container to cover the opening, wherein the closure assembly defines at least one fluid conduit for the fluid to flow from the internal compartment and through the closure assembly to a user, wherein the at least one fluid conduit includes at least one inlet through which fluid from the internal compartment may enter the fluid conduit, and at least one dispensing outlet through which fluid in the at least one fluid conduit may be dispensed from the closure assembly to a user; and two or more fluid level indicators defined in the insulation layer, each fluid level indicator comprising a translucent or transparent material configured to permit light to pass through the opaque layer and into the internal compartment, wherein at least two of the two or more fluid level indicators are positioned on circumferentially opposed sides of the fluid vessel;

wherein the insulation layer is at least substantially formed of a material with a thermal insulation that is quantified by a base thermal resistance value and wherein the two or more fluid level indicators are configured such that an average thermal resistance value across a full surface area of the insulation layer is at least 70% of the base thermal resistance value.

2. The fluid container of claim 1, wherein the insulation layer encloses a circumference of the internal compartment.

3. The fluid container of claim 1, wherein the insulation layer encloses one or more sides of the internal compartment.

4. The fluid container of claim 1, wherein at least one fluid level indicator in the two or more fluid level indicators comprises a circular-shaped fluid level indicator.

5. The fluid container of claim 1, wherein at least one fluid level indicator in the two or more fluid level indicators comprises a slit-shaped fluid level indicator.

6. The fluid container of claim 1, wherein the at least one dispensing outlet comprises a plurality of dispensing outlets, the closure assembly further comprising:

a closure base configured to be selectively coupled to the neck of the fluid vessel to selectively couple the closure assembly to the fluid vessel; and a valve assembly operatively coupled to the closure base and including the plurality of dispensing outlets, the plurality of dispending outlets including at least one drink outlet, at least one shower outlet, and a barrel valve, wherein each drink outlet is spaced apart from each shower outlet.

7. The fluid container of claim 6, wherein the valve assembly is configured to be selectively transitioned between:

a closed configuration that restricts flow of the fluid from the internal compartment to each of the at least one drink outlet and the at least one shower, a drink configuration that restricts flow of the fluid from the internal compartment to the at least one shower while permitting flow of the fluid from the internal compartment to the at least one drink outlet, and a shower configuration that restricts flow of the fluid from the internal compartment to the at least one drink outlet while permitting flow of the fluid from the internal compartment to the at least one shower outlet.

8. The fluid container of claim 7, wherein the barrel valve is configured to be selectively rotated about the rotational axis without concurrently translating along the rotational axis to transition the valve assembly between the closed configuration, the drink configuration, and the shower configuration.

9. The fluid container of claim 7, wherein the barrel valve is configured to be retained at a constant axial position along the rotational axis relative to the closure base when the valve assembly is selectively transitioned between the closed configuration, the drink configuration, and the shower configuration.

10. The fluid container of claim 7, the valve assembly further comprising:

an actuator configured to be engaged by a user to selectively transition the valve assembly between the closed configuration, the drink configuration, and the shower configuration, the actuator includes at least one actuator tab that extends away from the closure base.

11. The fluid container of claim 10, the valve assembly further comprising:

an outlet spout that defines each drink outlet, the outlet spout comprising an outlet nozzle that extends away from the closure base by an outlet nozzle height;

wherein each actuator tab extends away from the closure base by an actuator tab height; and wherein the actuator tab height is at least 75% of the outlet nozzle height.

12. The fluid container of claim 1, wherein the fluid vessel comprises a semi-rigid fluid vessel configured to be squeezed by a user to expel the fluid through the closure assembly.

13. The fluid container of claim 1, further comprising:

a dispensing spout that defines each dispensing outlet, the dispensing spout comprising a dispensing nozzle that extends away from a closure base of the closure assembly.

14. The fluid container of claim 13, wherein the dispensing nozzle extends less than 20 millimeters away from the closure base.

15. The fluid container of claim 14, wherein the dispensing nozzle extends less than 10 millimeters away from the closure base.

16. The fluid container of claim 15, wherein the dispensing nozzle extends less than 5 millimeters away from the closure base.

17. The fluid container of claim 13, further comprising:

one or more projections extending from the closure base, the one or more projections being configured to at least partially obstruct direct engagement between a mouth of the user and the dispensing nozzle.

18. The fluid container of claim 17, wherein the one or more projections extend from the closure base at least 75% of a length that the dispensing nozzle extends from the closure base.

19. The fluid container of claim 1, wherein the one or more first fluid level indicators comprise a plurality of fluid level features on the first side of the fluid vessel and the one or more second fluid level indicators comprise a single vertically-oriented fluid level strip on the second side of the fluid vessel.

20. The fluid container of claim 1, wherein the two or more fluid level indicators are configured such that an average thermal resistance value across a full surface area of the insulation layer is at least 80% of the base thermal resistance value.

21. The fluid container of claim 20, wherein the two or more fluid level indicators are configured such that an average thermal resistance value across a full surface area of the insulation layer is at least 90% of the base thermal resistance value.

22. The fluid container of claim 21, wherein the two or more fluid level indicators are configured such that an average thermal resistance value across a full surface area of the insulation layer is at least 95% of the base thermal resistance value.

* * * * *